US008938863B2

(12) United States Patent
Yamakita et al.

(10) Patent No.: US 8,938,863 B2
(45) Date of Patent: Jan. 27, 2015

(54) FASTENER STRINGER AND SLIDE FASTENER

(75) Inventors: Yoshimichi Yamakita, Toyama (JP); Masamichi Hasegawa, Toyama (JP); Yasushi Yamamoto, Toyama (JP); Nobuhiro Murai, Toyama (JP)

(73) Assignee: YKK Corporation (JP)

( * ) Notice: Subject to any disclaimer, the term of this patent is extended or adjusted under 35 U.S.C. 154(b) by 237 days.

(21) Appl. No.: 13/639,493

(22) PCT Filed: Apr. 6, 2010

(86) PCT No.: PCT/JP2010/056239

§ 371 (c)(1), (2), (4) Date: Oct. 4, 2012

(87) PCT Pub. No.: WO2011/125176

PCT Pub. Date: Oct. 13, 2011

(65) Prior Publication Data

US 2013/0019442 A1 Jan. 24, 2013

(51) Int. Cl.
*A44B 19/08* (2006.01)
*A44B 19/06* (2006.01)

(52) U.S. Cl.
CPC ..... *A44B 19/06* (2013.01)
USPC ..... 24/381; 24/405

(58) Field of Classification Search
CPC ..... A45C 13/1023; A45C 13/103; A45C 7/0027; A45C 7/0068; A44B 19/00; A44B 19/02; A44B 19/04; A44B 19/06; A44B 19/08; A44B 19/24; A44B 19/40; A44B 19/403
USPC ..... 24/381, 405
See application file for complete search history.

(56) References Cited

U.S. PATENT DOCUMENTS

| | | | | |
|---|---|---|---|---|
| 2,041,558 | A | 5/1936 | Marinsky | |
| 4,604,774 | A | 8/1986 | Yamaguchi et al. | |
| 5,035,029 | A * | 7/1991 | Horita et al. | 24/394 |
| 2005/0217085 | A1 * | 10/2005 | Lu | 24/381 |

FOREIGN PATENT DOCUMENTS

| | | | |
|---|---|---|---|
| EP | 153691 | A2 | 9/1985 |
| EP | 387905 | A2 | 9/1990 |
| JP | 60-179004 | A | 9/1985 |
| JP | 62-225387 | A | 10/1987 |

(Continued)

OTHER PUBLICATIONS

International Search Report, PCT Application No. PCT/JP2010/056239, mailed Jul. 13, 2010.

*Primary Examiner* — Jack W Lavinder
(74) *Attorney, Agent, or Firm* — Kilpatrick Townsend & Stockton LLP

(57) ABSTRACT

Disclosed is a fastener stringer where at least one surface of each of the fastener elements is colored. A plurality of fine fixing spaces is disposed on at least one surface of the fastener element which is colored. Accordingly, when a slide fastener is colored through an inkjet method, ink droplets ejected to the fastener element may be received by a plurality of fixing spaces and stably fixed onto a surface of the element. Consequently, a desired pattern or color can be continuously given to a fastener tape or the fastener element, and the contour of the pattern or color can be formed clearly and neatly.

11 Claims, 11 Drawing Sheets

(56) References Cited

FOREIGN PATENT DOCUMENTS

| | | | |
|---|---|---|---|
| JP | 64-20806 | A | 1/1989 |
| JP | 2-241401 | A | 9/1990 |
| JP | 4-24004 | A | 1/1992 |
| JP | 7-284404 | a | 10/1995 |
| JP | 2005-171448 | A | 6/2005 |
| JP | 2006-167507 | A | 6/2006 |

* cited by examiner

FASTENER STRINGER AND SLIDE FASTENER

This application is a national stage application of PCT/JP2010/056239 which is incorporated herein by reference.

TECHNICAL FIELD

The invention relates to a fastener stringer where fastener elements together with a fastener tape are colored by a coloring agent, and a slide fastener including the fastener stringer.

BACKGROUND ART

In general, a slide fastener is manufactured by mounting synthetic resin or metallic fastener elements to opposite marginal part of woven or knitted fastener tapes to form fastener stringers, and slidably mounting a slider to element rows of the left and right fastener stringers where one set has two obtained stringers. In such slide fastener, as the slider is slid along the element rows, the opposite fastener elements are coupled and released.

In general, various designs have been applied to clothes or bags until now, and new designs are required to increase values of products. In recent years, designs are required even for slide fasteners used in the clothes or bags, and fastener tapes or fastener elements to which various patterns or colors are applied are commercially available.

As methods for applying patterns or colors to fastener tapes or fastener elements, for example, a method of attaching a thermal transfer sheet having a predetermined pattern to a fastener stringer and then heat-treating the fastener stringer to transfer the pattern onto the fastener stringer, a method of printing a predetermined pattern on a fastener stringer through an inkjet method and then heat-treating the fastener stringer to color the fastener stringer, and the like are well known.

For example, a method and an apparatus for dyeing a slide fastener through an inkjet method are disclosed in Japanese Patent Application Laid-Open No. 4-24004 (Patent Document 1).

In the method of dyeing a slide fastener disclosed in Patent Document 1, first, a pattern is formed on a surface of the slide fastener by ejecting ink droplets from an inkjet nozzle onto a surface of the slide fastener including synthetic resin fastener elements. After that, a dye attached to the slide fastener is dyed onto a fastener tape and fastener elements by heat-treating the slide fastener to which the pattern is given.

Meanwhile, U.S. Pat. No. 2,041,558 (Patent Document 2) discloses a slide fastener where a large recess (or groove) is formed on a surface of a fastener element. The recess is basically a design of the fastener element and is formed on the surface of the element decoratively. According to Patent Document 2, after the fastener element is coated or plated, a filling material is filled in the recess of the fastener element, making it possible to show a color difference on the surface of the fastener element.

PRIOR ART DOCUMENT

Patent Document

Patent Document 1: Japanese Patent Application Laid-Open No. 4-24004

Patent Document 2: U.S. Patent No. 2,041,558

SUMMARY OF THE INVENTION

Problems to be Solved by the Invention

When a fastener tape and fastener elements are colored by using an inkjet method as in Patent Document 1, since ejected ink droplets permeate fibers of the fastener tape to be immediately fixed, a desired pattern or color can be neatly formed in the fastener tape.

However, when ink droplets are ejected onto a surface of the fastener elements, since it is difficult to fix the ink droplets attached to surfaces of the elements until they are heat-treated, the adjacent ink droplets are apt mix with each other such that a pattern or color is apt to spread (the contour of the pattern or color is apt to blur). For this reason, a desired pattern or color cannot be neatly formed in the fastener elements as compared with the fastener tape.

On the other hand, in the slider fastener disclosed in Patent Document 2, although a predetermined pattern can be given to a fastener element by filling a filling material in a recess formed in the fastener element and making the colors of a portion where the filling material is filled and a portion where the filling material is not filled different, a fine pattern or color cannot be given neatly to the fastener element as in the case of coloring a fastener element by using an inkjet method, as in, for example, Patent Document 1.

Further, when only a filling material is filled in the recess formed on a surface of the element, for example, when the slider is slid or the slide fastener collides with another object, the filling material is apt to drop out from the fastener element due to friction or impact applied to the fastener element.

Meanwhile, piece-dyeing (also, called beam-dyeing) is generally known as a method of dyeing a fastener stringer (or fastener chain). In the piece-dyeing method, a fastener stringer is wound on a dyeing beam, and the beam on which the fastener stringer is wound is accommodated in a dyeing pot to be dyed.

In a case where the fastener stringer is dyed by using piece-dyeing, when the fastener stringer is wound on the beam to overlap in several layers, the surfaces of the fastener element wound on a layer and the rear surfaces of the fastener element wound on the next layer are apt to be close to each other. For this reason, when the fastener stringer wound on the beam is dyed in the dyeing pot, it is difficult to widely spread the dye on the surface and rear surface of the fastener element, and there is a case where dyeing stains are generated in the dyed fastener element.

The invention has been made in an effort to solve the above-described problems, and the object of the invention is to provide a fastener stringer which may neatly provide a desired pattern or color a like a fastener tape when the fastener element attached to the fastener tape is colored through an inkjet method, and may be stably colored without generating color stains by widely spreading a dye on a surface of an element when the element is dyed through piece-dyeing, and to provide a slide fastener constituted by using such fastener stringer.

Means for Solving the Problems

In order to achieve the object, the fastener stringer provided by the invention basically includes a fastener tape, and a plurality of fastener elements attached along one marginal part of the fastener tape, at least one surface of each of the fastener elements being colored or surface-treated, and is characterized in that a plurality of fine fixing spaces is disposed on the at least one surface of the fastener element which is colored or surface-treated.

In particular, in the invention, recesses or bosses are disposed at a ratio of one to twenty five recesses or bosses per 1 $mm^2$ on the at least one surface of the fastener element which is colored or surface-treated, and the fixing spaces are defined by spaces formed in the recesses, or spaces formed around the bosses.

Further, in the fastener stringer according to the invention, it is preferable that a predetermined interval is formed between the adjacent recesses or the adjacent bosses.

In addition, in the fastener stringer of the invention, it is preferable that that the recesses or the bosses are formed to have a semispherical shape, a conic shape, or a frustum shape.

In this case, it is preferable that a capacity of a space formed for one of the recesses or the bosses is set to 0.002 $mm^3$ to 0.27 $mm^3$. Further, it is preferable that the plurality of recesses or bosses disposed on the one surface of the fastener element is formed to have the same shapes or similar shapes. Further, it is preferable that the plurality of recesses or bosses disposed on the one surface of the fastener element is disposed in zigzag.

Further, in the fastener stringer of the invention, the recesses or bosses may be formed to have a groove shape or a ridge shape along a predetermined direction.

In addition, in the fastener stringer of the invention, it is preferable that the fastener element is colored through an inkjet method, and in particular, it is preferable that the fastener element and the fastener tape are colored to have a pattern. In addition, the fastener element may be colored through post dyeing.

Furthermore, in the fastener stringer of the invention, it is preferable that the fastener element has a body fixedly attached to the fastener tape, a neck extending from the body to a tape outer side, and a coupling head disposed at a tip end of the neck, and a side wall surface of the body facing a tape inner side is formed to be flat.

In addition, according to the invention, a slide fastener having the above-configured fastener stringer is provided.

In the slide fastener according to the invention, it is preferable that, in at least one of an upper stopper disposed at one end of an element row formed by the fastener elements, a lower stopper or a separable bottom end stop disposed at an opposite end of the element row, and a slider slidable along the element row, the plurality of recesses or bosses is formed at a ratio of one to twenty five recesses or bosses per 1 $mm^2$ on a surface facing the same direction as one surface on which the recesses or bosses of the fastener element are disposed.

Effect of the Invention

In the fastener stringer according to the invention, at least one surface of a fastener element is colored or surface-treated, and a plurality of fine fixing spaces is disposed on at least one surface of the fastener element which is colored or surface-treated. In particular, in the invention, recesses or bosses are disposed at a ratio of one to twenty five recesses or bosses per 1 $mm^2$ on the at least one surface of the fastener element which is colored or surface-treated, and the fixing spaces are defined by spaces formed in the recesses or spaces formed around the bosses.

Further, in the invention, the coloring or surface-treatment performed on the fastener element is not specifically limited. As the coloring performed to the fastener element, for example, a method of performing the coloring by using a dye ink or a pigment ink through the above-described inkjet method may be properly used, or a method of piece-dyeing or painting through ejection may be used. In addition, as the surface-treatment performed on the fastener element, a coating forming processing such as plating or deposition or a processing of adhering a sheet-shaped film through thermal transfer may be used.

Thus, when the fastener stringer according to the invention where the fixing spaces are defined by the recesses or bosses on a surface of the fastener element as described above is, for example, colored through an inkjet method, the ink droplets ejected onto the surface of the fastener element can be received by the fixing spaces on the surface of the element and the ink droplets attached to the surface of the element can be stably fixed.

Accordingly, since the adjacent ink droplets attached to the surface of the element can be prevented from being mixed with each other, the pattern or color given to the fastener element can be prevented from being spread (the contour of the pattern or color can be prevented from being blurred), and the contour of the pattern or color can be clearly and neatly formed. Thus, a desired pattern or color can be neatly given to the fastener element like the fastener tape.

Although in the slide fastener of Patent Document 2, the recess is formed on a surface of the fastener element, the recess formed in Patent Document 2 is formed so large that the recess itself appears as a decoration. For this reason, for example, even when an ink is ejected onto a surface of the fastener element of Patent Document 2 through an inkjet method, the plurality of ink droplets is mixed in the recess, causing the problem of spreading the pattern or color and blurring the contour.

Meanwhile, when the fastener stringer of the invention is dyed through piece-dyeing, since the fixing spaces are formed on the surface of the fastener element, even when the fastener stringer is wound on a beam to overlap, a dye can smoothly and widely be spread on the surface and rear surface of the fastener element. For this reason, the fastener stringer can be uniformly dyed with a desired color without generating color stains in the fastener element.

When the fastener stringer is painted and colored through ejection, coated through plating and deposition, or surface-treated by adhering a sheet-shaped film through thermal transfer, as the fixing spaces are formed on the surface of the fastener element, a bonding property or an attaching property between a surface of the fastener element and the coating (including a paint film) formed on the same surface or the film adhered to the same surface can be enhanced. Thus, a quality of the fastener stringer can be stably maintained over a long period of time by making it difficult to peel off the coating or film disposed on the fastener element.

In the fastener stringer according to the invention, a predetermined interval is formed between the adjacent recesses or the adjacent bosses. Accordingly, when the fastener stringer is colored by using an inkjet method, the ink droplets ejected onto the surface of the fastener element can be efficiently fixed, and thus the ink droplets can be prevented even more certainly from being mixed with each other.

Further, in the fastener stringer according to the invention, the recesses or bosses are formed to have a semispherical shape, a conic shape, or a frustum shape. Accordingly, when the fastener stringer is colored by using an inkjet method, the ink droplets ejected onto the surface of the fastener element can be fixed with certainty. Further, when the fastener stringer is dyed through piece-dyeing, the fastener stringer can be stably dyed by widely spreading a dye on the surface or rear surface of the fastener element with certainty.

In addition, when the fastener stringer is painted and colored through ejection, coated through plating and deposition, or surface-treated by adhering a sheet-shaped film through thermal transfer, a bonding property or an attaching property of the coating or film disposed on the fastener element can be enhanced.

In this case, as a capacity of the space formed by one of the recesses or bosses is set to 0.002 $mm^3$ to 0.27 $mm^3$, for example, when the fastener stringer is colored at a resolution of approximately 180 dpi by using an inkjet method, the ink droplets ejected onto the surface of the fastener element can be stably fixed.

Further, in the invention, the capacity of the space formed by one recess is a capacity of the space formed at a portion pressed to be recessed with respect to the surface of the fastener element, and may be obtained by using a generally known calculation equation for obtaining a volume of a three-dimensional body. For example, when the recesses are formed to have a semispherical shape, the capacity of the spaces may be calculated from the radius value of the semi-spherical recesses. Meanwhile, the capacity of the spaces formed by one boss is obtained, for example, by calculating a capacity of the space formed between a plane connecting the apexes of the bosses formed on a surface of the element in a predetermined region and a surface of the fastener element, and then by dividing the calculated capacity of the fixing spaces in the predetermined region by the number of bosses disposed in the predetermined region.

In addition, as the plurality of recesses or bosses disposed on the surface of the fastener element which is colored or surface-treated is formed to have the same shapes or similar shapes, or as the plurality of recesses or bosses disposed on the surface of the fastener element which is colored or surface-treated is disposed in zigzag, the recesses or bosses can be uniformly formed on the entire surface of the fastener element. For this reason, the ink droplets ejected onto the entire surface of the fastener element can be stably fixed at each location, and the ink droplets can be more certainly prevented from being mixed with each other.

Meanwhile, in the fastener stringer of the invention, the recesses or bosses may be formed to have a groove shape or a ridge shape along a predetermined direction such as, for example, a widthwise direction of the fastener tape, a lengthwise direction of the fastener tape or a direction inclined by a predetermined angle with respect to the widthwise direction of the fastener tape. Even in this case, when the fastener stringer is colored by using an inkjet method, the ink droplets ejected onto the surface of the fastener element can be fixed with certainty.

Further, when the fastener stringer is dyed through piece-dyeing, a dye can be widely spread on the surface or rear surface of the fastener element with certainty. Further, when the fastener stringer is painted and colored through ejection, coated through plating and deposition, or surface-treated by adhering a sheet-shaped film through thermal transfer, a bonding property or an attaching property of the coating or film disposed on the fastener element can be further enhanced.

In addition, in the fastener stringer of the invention, as the fastener element is colored by an inkjet method, a desired pattern or color can be continuously given to the fastener tape and the fastener element, and the contour of the pattern or color can be clearly and neatly formed. For this reason, an outer appearance of the fastener stringer can be enhanced.

Meanwhile, in the fastener stringer of the invention, dyeing stains can be prevented from being generated in the fastener element even by coloring the fastener element through post dyeing, uniformly giving a desired color to the fastener element. For this reason, an outer appearance of the fastener stringer can be enhanced.

Further, in the fastener stringer of the invention, the fastener element has a body fixedly attached to the fastener tape, a neck extending from the body to an outer side of the tape, and a coupling head disposed at a tip end of the neck, and convexo-concavities are not formed on a side wall surface of the body facing an inner side of the tape and the side wall surface is formed to be flat.

Accordingly, when the fastener stringer is viewed from a front side, since it is difficult to discern a border between the fastener tape and the fastener element, it can appear that the pattern or color given to the fastener tape and the fastener element is continuous between the fastener tape and the fastener element.

Further, the slide fastener provided by the invention is configured by using the fastener stringer having the above-described configuration. In the slide fastener of the invention, as the fastener stringer is colored by using an inkjet method, the contour of the pattern or color given to the fastener element is formed clearly and an outer appearance of the slide fastener is enhanced. Further, in the slide fastener, as the fastener stringer is dyed through piece-dyeing in the slide fastener, dyeing stains are not generated in the fastener element and an outer appearance of the slide fastener is enhanced.

In the slide fastener according to the invention, in at least one of an upper stopper disposed at one end of an element row, a lower stopper or a separable bottom end stop disposed at an opposite end of the element row, and a slider slidable along the element row, the plurality of recesses or bosses for fixing a coloring agent is formed at a ratio of one to twenty five recesses or bosses per 1 $mm^2$ on the same surface as that of the fastener element.

Accordingly, when the fastener components such as the upper stopper, the lower stopper, the separable bottom end stop, and the slider are colored by using an inkjet method, a desired pattern or color can be stably given to the fastener components continuously from the fastener tape or the fastener element, and the contour of the pattern or color can be clearly and neatly formed. Further, when the above-described fastener components are dyed through piece-dyeing, dyeing stains are not generated in the fastener components and a desired color can be uniformly given.

MODE FOR CARRYING OUT THE INVENTION

Hereinafter, embodiments of the invention will be described in detail with reference to the accompanying drawings. However, the invention is not limited to the embodiments which will be described hereinbelow, but may be variously modified so long as the modifications have substantially the same configuration and operational effects.

For example, although a fastener stringer where a plurality of synthetic resin fastener elements is attached along a marginal part of a fastener tape through injection molding and a slide fastener will be described in the following embodiments, the fastener stringer and the slide fastener according to the invention are not limited thereto, but a plurality of metallic fastener elements may be attached along a marginal part of a fastener tape through die casting.

First Embodiment

Figure 1:
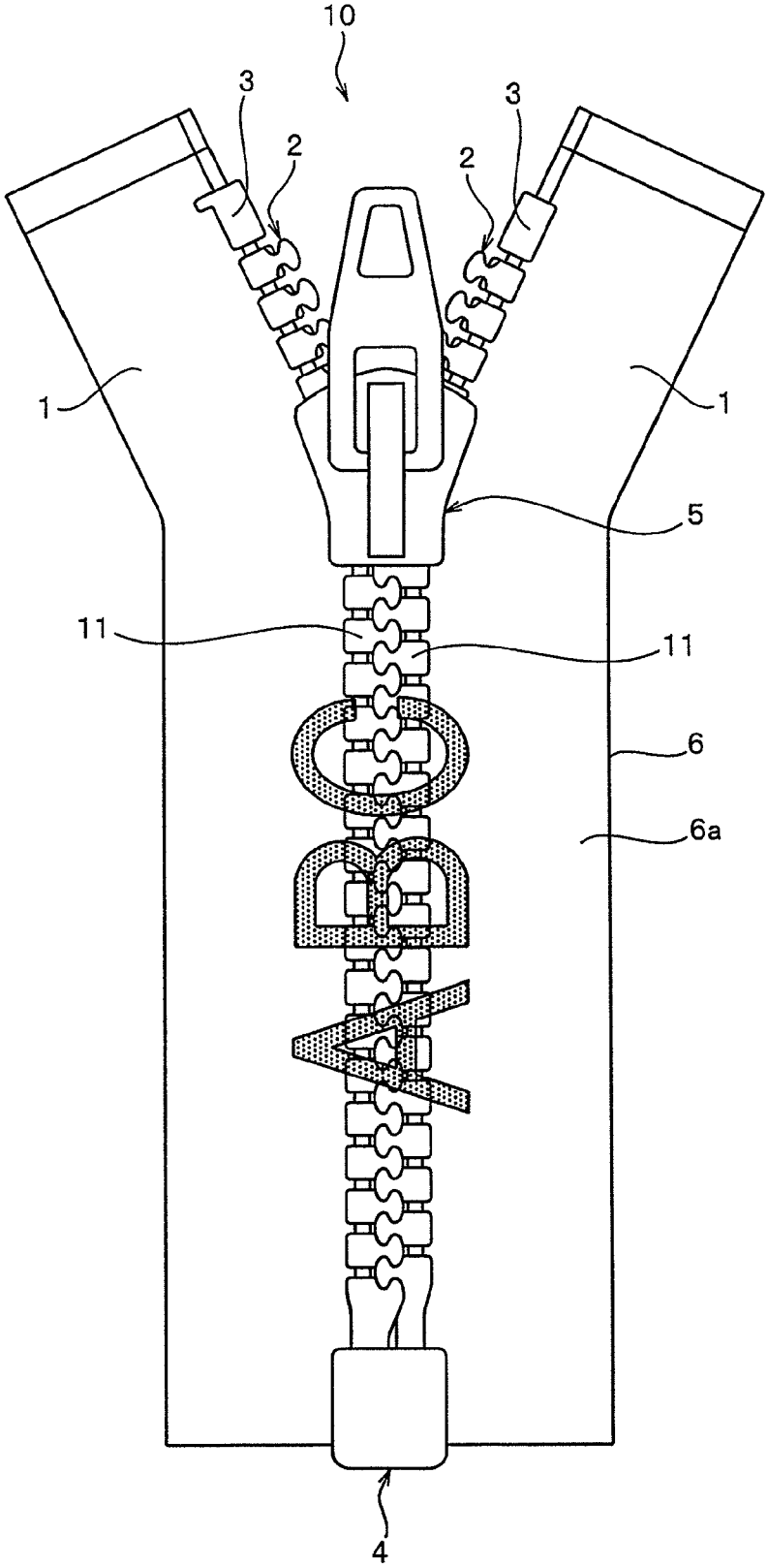
FIG. 1 is a front view illustrating a slide fastener according to a first embodiment of the invention.
Figure 2:
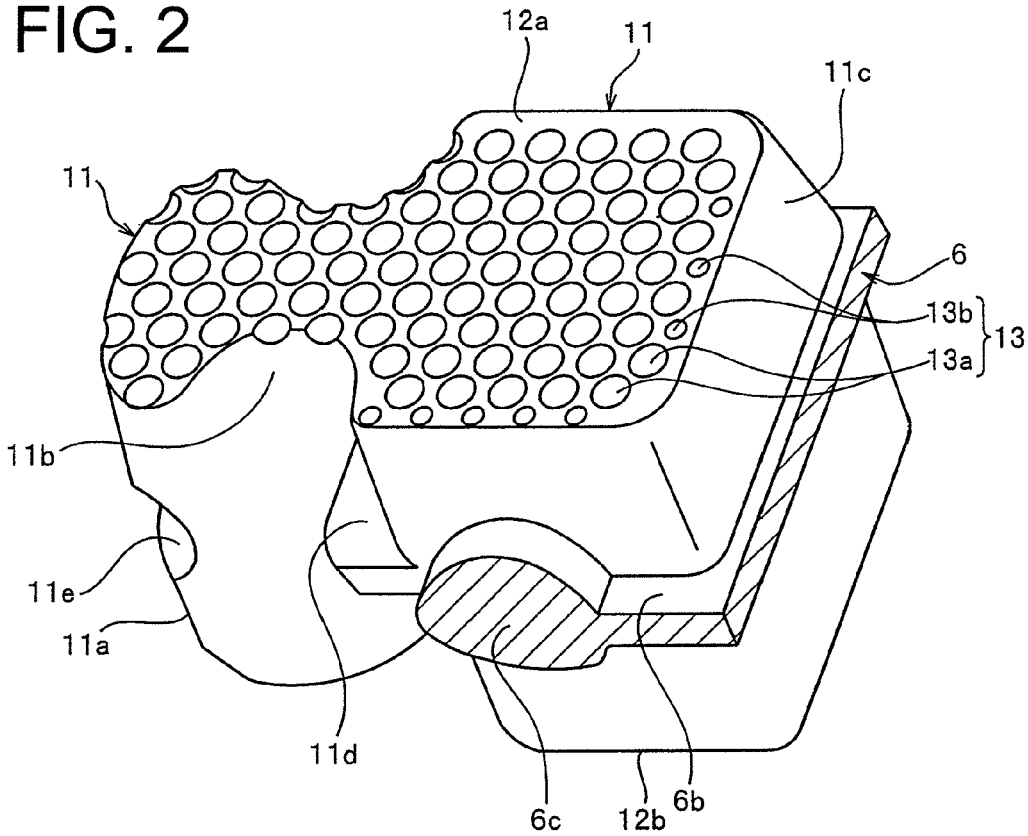
FIG. 2 is an enlarged perspective view illustrating a fastener element of the slide fastener.
Figure 3:
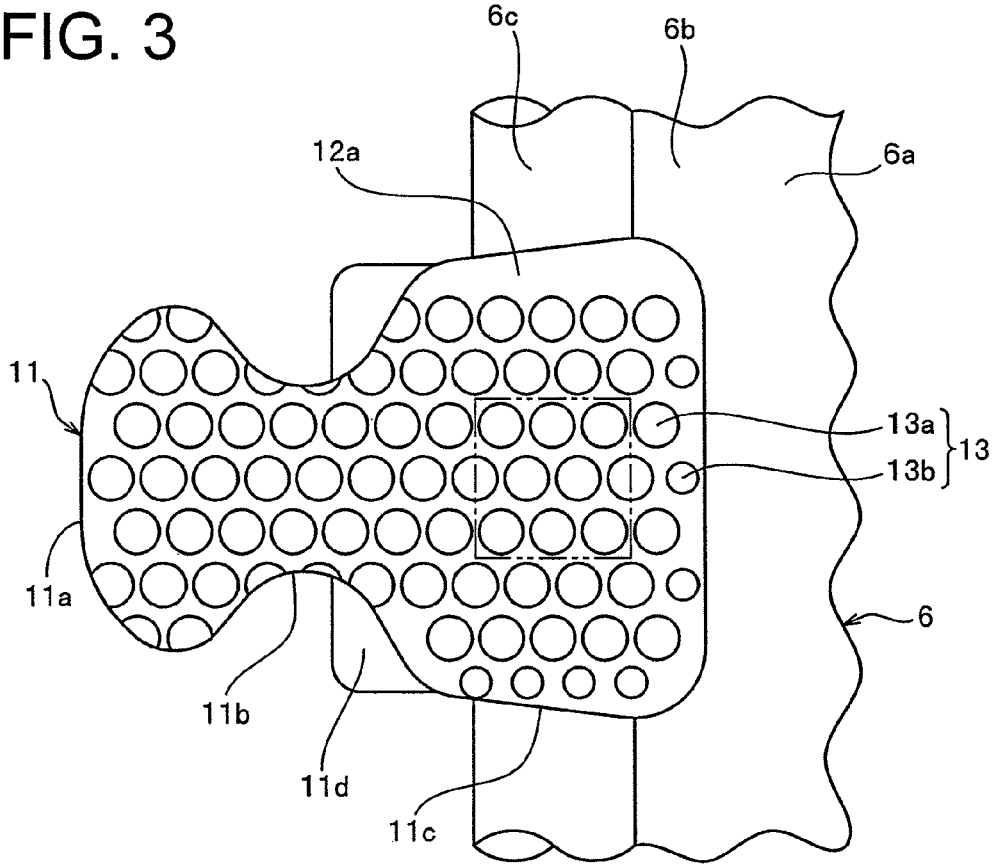
FIG. 3 is a front view of the fastener element.
Figure 4:
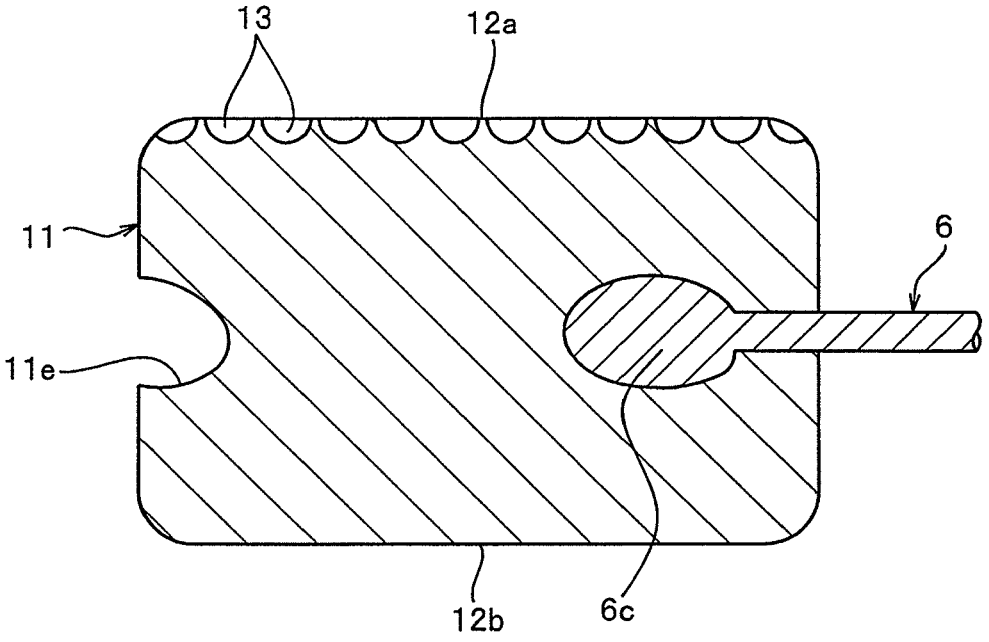
FIG. 4 is a sectional view of the fastener element.

FIG. 1 is a front view illustrating a slide fastener according to a first embodiment of the invention. FIG. 2 is an enlarged perspective view illustrating a fastener element of the slide fastener. FIGS. 3 and 4 are respectively a front view and a sectional view of the fastener element.

A slide fastener 10 according to the first embodiment includes a pair of left and right fastener stringers 1 having element rows 2 at marginal parts of facing tapes, respectively, left and right upper stoppers 3 fixedly attached to ends of the element rows 2, a separable bottom end stop 4 disposed at opposite ends of the element rows 2, and a slider 5 slidably disposed along the element rows 2 to couple or separate the left and right element rows 2.

Each of the left and right fastener stringers 1 according to the first embodiment includes a fastener tape 6, and a plurality of synthetic resin fastener elements 11 attached to an opposite marginal part of the fastener tape 6. Each of the left and right fastener tapes 6 is woven or knitted to have a band shape having a fine width, and has a tape main body 6*a* sewn to a fastener attached product, and an element mounting portion 6*b* to which the plurality of fastener elements 11 is mounted. Further, a core thread 6*c* is installed at a tape side marginal part of the element mounting portion 6*b* of the fastener tape 6. The core thread 6*c* has an expanded shape, and is woven and knitted integrally with the fastener tape 6.

The synthetic resin fastener elements 11 are arranged and installed in the element mounting portion 6*b* having the core thread 6*c* of the fastener tape 6 along a lengthwise direction of the fastener tape 6 through injection molding to form the element row 2. In this case, each of the fastener elements 11 is symmetrically formed to the front and back with the fastener tape 6 being interposed therein, and has a coupling head 11*a* having an elliptical shape in a lengthwise direction of the fastener tape 6, a body 11*c* fixedly attached to the fastener tape 6 to support the core thread 6*c*, a neck 11*b* formed to be tied between the coupling head 11*a* and the body 11*c* to serve as a narrow neck into which a coupling head 11*a* of a counterpart fastener element 11 is put, and wing-shaped shoulders 11*d* extending along the neck 11*b* and the body 11*c*. Further, concave recesses 11*e* into which shoulders 11*d* of the counterpart fastener element 11 are put are formed on a circumferential wall of a tip end side of the coupling head 11*a*.

Further, each of the fastener elements 11 has a first surface 12*a* disposed at an outer surface side of the slide fastener 10, and a second surface 12*b* disposed on a rear side surface opposite to the first surface 12*a*, and the first and second surfaces 12*a* and 12*b* are formed along the coupling head 11*a*, the neck 11*b*, and the body 11*c*. For example, the first surface 12*a* is a surface on a front side illustrated in FIG. 1, and the second surface 12*b* is a surface opposite thereto.

A plurality of recesses 13 is formed on the first surface 12*a* of the fastener element 11 to be recessed with respect to a planar portion, and the recesses 13 are regularly arranged in zigzag. In the following description, the zigzag shape refers to an arrangement where the recesses 13 (recesses 63 in a fifth embodiment which will be described below) are disposed to have a row shape while maintaining an interval with the adjacent recesses 13 and the recesses 13 forming one row are located between the recesses 13 forming the adjacent rows of the corresponding row. Further, the zigzag arrangement is the same in the case of bosses 33 which will be described below as well as in the case of the recesses 13. In this way, by employing the zigzag arrangement, more recesses 13 (or recesses 63) or bosses 33 may be formed in the same area.

In the first embodiment, for example, when the fastener element 11 is colored through an inkjet method as will be described below, spaces defined in the recesses 13 function as fixing spaces for receiving ink droplets ejected onto the first surface 12*a* to fix the ink droplets.

Further, in the first embodiment, the recesses 13 formed in each of the fastener elements 11 include first semispherical recesses 13*a* formed on a substantially entire surface of the first surface 12*a*, and second semispherical recesses 13*b* disposed at circumferential portions of the body 11*c* along a ridgeline of the body 11*c* and formed to be recessed smaller than the first recesses 13*a*. In this case, the first recesses 13*a* disposed at circumferential portions of the coupling head 11*a* and circumferential portions of the neck 11*b* have shapes as though some portions of semispherical bodies have flaws.

In addition, in the invention, all the recesses 13 formed on the first surface 12*a* of the fastener element 11 may be set to have the same size or may be set to have three or more different sizes. Further, although the shapes of the recesses 13 formed on the first surface 12*a* are not limited to semispherical shapes but conic shapes (see, for example, a fastener element 61 of the fifth embodiment which will be described below) or frustum shapes (obtained by cutting a conic shape along a plane parallel to the bottom thereof and excluding the small conic shape) may be employed, it is preferable that all the recesses 13 formed on the first surface 12*a* have the same or similar shapes. Accordingly, when the fastener element 11 is colored through an inkjet method, ink droplets can be stably fixed to the fastener element 11 or an outer appearance of the fastener element 11 can be enhanced.

In this case, the recesses 13 formed in the fastener element 11 are disposed at a ratio of one to twenty five recesses per area of 1 $mm^2$. In particular, as described below, when a color treatment is performed at a resolution of 180 dpi through an inkjet method, it is preferable that the recesses 13 are disposed at a ratio of nine to sixteen recesses per area of 1 $mm^2$ as illustrated by an imaginary line in FIG. 3. In FIG. 3, a total of nine recesses 13, that is, eight recesses 13 and two recesses 13 cutoff to have a substantially half size by the imaginary line, are disposed in an area of 1 $mm^2$ illustrated by the imaginary line.

In general, convexo-concavities corresponding to the thickness of fibers are formed on a surface of the fastener tape 6 as the fastener tape 6 of a fastener stringer 1 is woven or knitted with fibers. Accordingly, when the fastener stringer 1 is colored through an inkjet method, a resolution of approximately 180 dpi is frequently employed, considering the convexo-concavities of the fastener tape 6 (for example, even if the fastener tape 6 is colored at a resolution of approximately 720 dpi, which is higher than 180 dpi, through an inkjet method, it actually appears that the fastener tape 6 is colored at a resolution of approximately 180 dpi).

Further, according to the experiments and reviews conducted by the inventors, when the fastener element 11 is colored (particularly, dyed), for example, through an inkjet method, it became clear that an ink film having a thickness of 0.05 mm or thicker needs to be formed on the first surface 12*a* of the fastener element 11 in order to clearly express a pattern or a color given to the fastener element 11 or show fine effects of shading.

In addition, when the fastener element 11 is colored at a resolution of approximately 180 dpi through an inkjet method, it is also clear that an amount of ink amounting from 0.002 $mm^3$ to 0.005 $mm^3$ is required for one pixel in order to form an ink film having the above-described thickness.

Thus, in a case where the above-described amount of ink is required when the fastener stringer 1 is colored at a resolution of approximately 180 dpi through an inkjet method, if a ratio of the recesses 13 per area of 1 $mm^2$ of the first surface 12*a* is smaller in one in the fastener element 11, the recesses (fixing spaces) 13 cannot sufficiently receive ink droplets (amount of ink) ejected onto the surface of the fastener element 11, and adjacent ink droplets are mixed with each other such that the pattern or color are apt to spread or get rough.

Meanwhile, if a ratio of the recesses 13 per area of 1 $mm^2$ of the first surface 12*a* becomes more than twenty five, the number of the recesses 13 becomes sufficiently large but the size (diameter) of the recesses 13 becomes rather too small to secure a sufficient capacity in the fixing spaces of the recesses 13.

For this reason, the ink droplets (ink amount) ejected onto the surface of the fastener element 11 cannot be accurately received by the recesses 13 and the adjacent ink droplets are easily mixed with each other. Further, in order to make a ratio of the recesses 13 per area of 1 $mm^2$ more than twenty five, it is also considered that much time and high costs are consumed to machine a mold for forming the fastener element 11 and manufacturing costs for the fastener stringer 1 will increase remarkably.

Thus, by setting a ratio of the recesses 13 per area of 1 $mm^2$ of the first surface 12*a* to one to twenty five as in the first embodiment, the ink droplets ejected onto the first surface 12*a* of the fastener element 11 can be received by the recesses 13 (fixing spaces) with certainty and the ink droplets can be stably fixed to the first surface 12*a*. For this reason, the adjacent ink droplets can be effectively prevented from being mixed with each other, and manufacturing costs for the fastener stringer 1 can be prevented from increasing.

Further, according to the experiments and reviews conducted by the inventors, in a case where a ratio of the recesses 13 per area of 1 $mm^2$ is set as described above, it became clear that, in order to receive and fix an amount of ink amounting from 0.002 $mm^3$ to 0.005 $mm^3$ for one pixel by the recesses 13, it is preferable to set a capacity of the spaces (fixing spaces) of the recesses 13 (except for the recesses 13 having a flaw therein) formed in the fastener element 11 to 0.002 $mm^3$ to 0.27 $mm^3$ and set a diameter of the recesses 13 to 0.05 mm to 0.5 mm. Moreover, it also became clear that it is preferable to set an interval between the adjacent recesses 13 to 0.05 mm to 0.3 mm.

Thus, in the fastener element 11 of the first embodiment, the diameter of the first recesses 13*a* on the first surface 12*a* are set to 0.3 mm and the capacity of the spaces are set to 0.008 $mm^3$. Further, the diameter of the second recesses 13*b* on the first surface 12*a* is set to 0.2 mm and the capacity of the spaces is set to 0.002 $mm^3$.

Further, the interval between the adjacent first recesses 13*a* is set to 0.05 mm. Meanwhile, as illustrated in FIGS. 2 and 3, the second recesses 13*b* are disposed at circumferential portions of the first surface 12*a* in the body 11*c* of the fastener element 11, and the interval between the adjacent first recesses 13*a* is set to 0.10 mm.

The above-described fastener element 11 having the plurality of recesses 13 is fixedly attached to the fastener tape 6 to have a predetermined shape by injection-molding a synthetic resin in the fastener tape 6 by using an injection-molding mold. In this case, the material of the fastener element 11 may be a thermoplastic resin such as polyacetal, polypropylene, polybutylene terephtalate, and nylon. Further, a plurality of bosses is formed on a cavity surface of the injection-molding mold to form the plurality of recesses 13 with a predetermined size at predetermined locations of the fastener element 11, and the plurality of bosses is formed by performing an electric discharge machining on the cavity surface.

Further, in the fastener element 11 of the first embodiment, the above-described recesses 13 are formed in the first surface 12*a* of the coupling head 11*a*, the neck 11*b*, and the body 11*c*, but are not formed on side wall surfaces of the coupling head 11*a*, the neck 11*b*, and the body 11*c*. In particular, in the fastener element 11, side wall surfaces of the body 11*c* facing an inner side of the fastener tape 6 are formed flat.

The side wall surfaces include surfaces of the body 11*c* facing those of the adjacent fastener elements 11 disposed in a row in a lengthwise direction of the fastener tape 6, and surfaces following a lengthwise direction of the fastener tape 6 and facing a widthwise direction of the fastener tape 6 opposite to the coupling head 11*a*. Here, in the fastener tape 6, a counterpart fastener tape 6 side with respect to a periphery of the element mounting portion 6*b* will be taken as an outer side of the fastener tape 6, and a tape main body 6*a* side with respect to a periphery of the element mounting portion 6*b* which is opposite to the outer side of the fastener tape 6 will be taken as an inner side of the fastener tape 6. Further, the flat side wall surfaces means that the above-described fixing spaces (recesses 13) are not disposed on the side wall surfaces.

As the side wall surface of the body 11*c* facing the inner side of the fastener tape 6 is formed flat, when the slide fastener 10 is viewed from a front side, it is difficult to discern a border between the fastener tape 6 and the fastener element 11 and adjacent ink droplets are easily mixed with each other when the ink droplets are attached to the side wall surface. For this reason, it may appear that the pattern or color given to the fastener tape 6 and the fastener element 11 are not interrupted on the way at a border between the fastener tape 6 and the fastener element 11 but are continuous.

Further, the surfaces of the shoulders 11*d* on the first surface 12*a* side and the second surface 12*b* side are flat, and fixing spaces (recesses 13) are not formed on any surface. The shoulders 11*d* are portions suited to the concave recesses 11*e* of the coupling counterpart when the left and right fastener elements 2 are coupled to each other. For this reason, as the recesses 13 are not formed on the first surface 12*a* and the second surface 12*b* of the shoulders 11*d*, when a front and back force of the fastener tape 6 is applied to the coupled left and right fastener elements 2, contact areas between the first surface 12*a* or the second surface 12*b* of the shoulders 11*d* and the inner walls of the concave recesses 11*e* become larger, easily securing a strength against the front and back force.

Meanwhile in the slide fastener 10 of the first embodiment, the left and right upper stoppers 3, the separable bottom end stop 4, and the slider 5 have the same configurations as those generally used in the related art.

That is, as the left and right upper stoppers 3 are injection-molded of the same type of synthetic resin as the fastener element 11, the left and right upper stoppers 3 are fixedly attached to ends of the element rows 2 and prevent the slider 5 from being separated from the ends of the element rows 2.

The separable bottom end stop 4 has a separable pin, a box pin, and a box, and the separable pin is configured to be extracted from and inserted into the box. As the separable bottom end stop 4 is disposed in the slide fastener 10, it is possible to separate the left and right fastener stringers 1.

The slider 5 has an upper blade, a lower blade, a diamond connecting the upper and lower blades, upper and lower flanges extending to approach each other from left and right ends of the upper and lower blades, a tab mounting column erected on an upper surface of the upper blade, and a tab rotatably mounted to the tab mounting column.

In regard to the slide fastener 10 of the first embodiment having the above-described configuration, desired pattern and color by which the fastener tape 6 and the fastener element 11 are continuous can be easily given as illustrated in FIG. 1 by coloring the fastener tape 6 and the fastener element 11 at a resolution of 180 dpi through a dyeing method which is an inkjet method described in, for example, Patent Document 1.

In describing the dyeing method in more detail, dye ink droplets are ejected to the entire widthwise direction of the fastener tape 6 from an inkjet nozzle installed at a predetermined location toward an outer surface (a surface on the same side as the first surface 12*a* of the fastener element 11) of the slide fastener 10 while the slide fastener 10 of the first embodiment is first transported at a predetermined speed in a lengthwise direction of the fastener tape 6.

In this case, as the inkjet nozzle ejects ink from an ultrasonic head disposed in the nozzle and the ultrasonic head provides the ink with ultrasonic vibrations, the ink is ejected in the form of fine droplets. Further, when the ink droplets are ejected from the ultrasonic head, electric charges are given to the ink droplets by electrodes in the inkjet nozzle.

Further, when the ink droplets ejected from the ultrasonic head pass by a deflector disposed in the inkjet nozzle, the locus of the ink droplets is curved toward a predetermined direction by the electric charges given to the ink droplets and are ejected to the fastener tape 6 or the fastener element 11 to form desired pattern and color.

Further, the ink droplets ejected to the fastener tape 6 is fixed to the fastener tape 6 after permeating the fibers constituting the fastener tape 6. Further, the ink droplets ejected to the fastener element 11 are received by the plurality of semi-spherical recesses 13 disposed in zigzag on the first surface 12*a* of the fastener element 11 and are fixed to the first surface 12*a*.

In particular, since the recesses 13 formed in the fastener element 11 of the first embodiment have a predetermined size and a predetermined spatial capacity as described above, the ink droplets ejected to the fastener element 11 can be received by the fixing spaces of the recesses 13 with certainty and the ink droplets can be stably fixed to the first surface 12*a* of the fastener element 11.

For this reason, the adjacent ink droplets attached to the first surface 12*a* of the fastener element 11 can be effectively prevented from being mixed with each other. Further, in the fastener element 11 of the first embodiment, since the second recesses 13*b* formed smaller than the first recesses 13*a* are disposed at circumferential portions of the body 11*c* and the first recesses 13*a* having flaws in some portions of the semi-spherical bodies are disposed at circumferential portions of the coupling head 11*a*, circumferential portion of the neck 11*b*, and circumferential portions of the body 11*c*, the ink droplets can be stably received by the first and second recesses 13*a* and 13*b* to be fixed even in the circumferential portions of the first surface 12*a*.

Thereafter, a desired pattern (for example, an alphabet letter) or color is continuously dyed in the fastener tape 6 and the fastener element 11 as illustrated in FIG. 1 and the contour of the pattern or color is formed clearly and neatly, by heat-treating the slide fastener 10 where ink droplets are attached to the fastener tape 6 and the fastener element 11, making it possible to obtain the slide fastener 10 with an enhanced outer appearance.

The heat treatment is performed by passing the slide fastener 10, for example, through a heated atmosphere, and is also called a dry heat treatment. Although an example of ejecting ink droplets to the slide fastener 10 having a predetermined length to perform a heat treatment has been described until now, according to the invention, the slide fastener 10 may also be obtained, for example, by ejecting and attaching ink droplets to a continuous fastener stringer 1 which is not yet cut to a predetermined length, subsequently performing a heat treatment on the continuous fastener stringer 1 to dye the continuous fastener stringer 1, then mounting an upper stopper 3, a separable bottom end stop 4, and a slider 5 on a pair of fastener stringers 1, and cutting the fastener stringers 1 by a predetermined length.

Further, although a case of coloring the slide fastener 10 by using a dye ink has been described in the above-described dyeing method which is an inkjet method, in the invention, it is also possible to color the slide fastener 10 by using a pigment ink instead of a dye ink. The pigment ink is different from a dye ink where dye is dissolved in a solvent, and is a type of ink where pigments are not dissolved in a solvent but are dispersed in the solvent. Even when the slide fastener 10 is colored by using the pigment ink, ink droplets can be stably fixed to the fastener element 11 and the contour of the pattern or color can be shown clearly.

Further, in the invention, when the fastener tape 6 and the fastener element 11 are colored as described above, a color treatment may be performed in the form of a slide fastener 10 and may also be performed in the form of a fastener chain or in the form of a fastener stringer 1.

In addition, the slide fastener 10 according to the first embodiment may be dyed through piece-eying instead of being colored by using the above-described inkjet method.

When piece-dyed, dyeing is done in the form of a fastener chain before the slider 5 is mounted or in the form of the fastener stringer 1. For example, the fastener chain (or fastener stringer 1) is wound on a dyeing beam to overlap in several layers and is accommodated in a dyeing pot while the fastener chain remains wound on the beam, and the fastener chain is dyed in the dyeing pot.

In this case, in the fastener chain according to the first embodiment, the plurality of recesses 13 are formed on the entire first surface 12*a* of each fastener element 11. Further, it appears that the portions of the first surface 12*a* where the recesses 13 are not disposed are formed to be planar when viewed by naked eyes, but when observed in an order of micrometer through a microscope and the like, high and low portions are formed in the plane because of the formation of the recesses 13 and the plane has slight height differences.

Accordingly, even if the fastener chain is wound on the beam to overlap in several layers, a small gap is formed between a surface of a fastener element 11 wound on a layer and a rear surface of a fastener element 11 wound on the next layer. For this reason, when the fastener chain is dyed in the dyeing pot, a dye can be smoothly and widely spread on a surface and a rear surface of the fastener element 11 by circulating the dye in the gap. As a result, the fastener chain can be uniformly and stably dyed to have a desired color without generating color stains in the fastener element 11.

Furthermore, with regard to the slide fastener 10 of the first embodiment, the first surface 12*a* of the fastener element 11 may be painted and colored through ejection. Further, the fastener element 11 may be plated with a metal, or the fastener stringer 1 may be deposited in a predetermined atmosphere (for example, in an aluminum atmosphere) so that a surface of the fastener element 11 may be surface-treated by forming a film thereon. Further, a surface of the fastener element 11 may be surface-treated by adhering a sheet-shaped film thereto through thermal transfer.

In addition, when the slide fastener 10 of the first embodiment is surface-treated, for example, colored through painting, metal plating or deposition as described above, since the plurality of recesses 13 is disposed on the first surface 12*a* of each fastener element 11 and a fine fixing space having a predetermined capacity is formed in each recess 13, some portion of the paint film or the film enter the fixing space to be fixed with certainty. Accordingly, since an attaching strength between the first surface 12*a* of the fastener element 11 and the paint film or film formed on the first surface 12*a* can be remarkably increased, the paint film or film formed on the fastener element 11 cannot be easily peeled off.

In regard to the dyeing and painting, dyeing means that a surface of a resin and an interior near the surface are colored by a dye and painting means that a color is stacked on a surface. For this reason, when a fastener tape and a fastener element are dyed, it is preferable that the fastener tape and the fastener element are made of a material which can be dyed by the same dye. For example, it is preferable that when the material of the fastener tape is a polyester resin, the fastener element is made of a polyester resin or a polybutylene terephtalate, and it is preferable that when the material of the fastener tape is a polyamide resin, the fastener element is made of a polyamide resin.

Further, when the slide fastener 10 of the first embodiment is surface-treated by adhering a sheet-shaped film through thermal transfer, since the plurality of recesses 13 is disposed on the first surface 12*a* of each fastener element 11 and a fine fixing space having a predetermined capacity is formed in each recess 13, an adhesive enters the fixing space to be fixed. Accordingly, since a bonding strength between the first surface 12*a* of the fastener element 11 and the film adhered onto the first surface 12*a* can be remarkably increased, the film adhered to the first surface 12*a* of the fastener element 11 cannot be easily peeled off.

In addition, in the slide fastener 10 according to the first embodiment, it has been described that the recesses 13 are formed only on the first surface 12*a* of the fastener element 11. However, the invention is not limited thereto, but the semispherical recesses 13 maybe formed not on the first surface 12*a* of the fastener element 11 but only on the second surface 12*b* on the opposite side thereof, or may be formed on both the first surface 12*a* and the second surface 12*b*.

Figure 5:
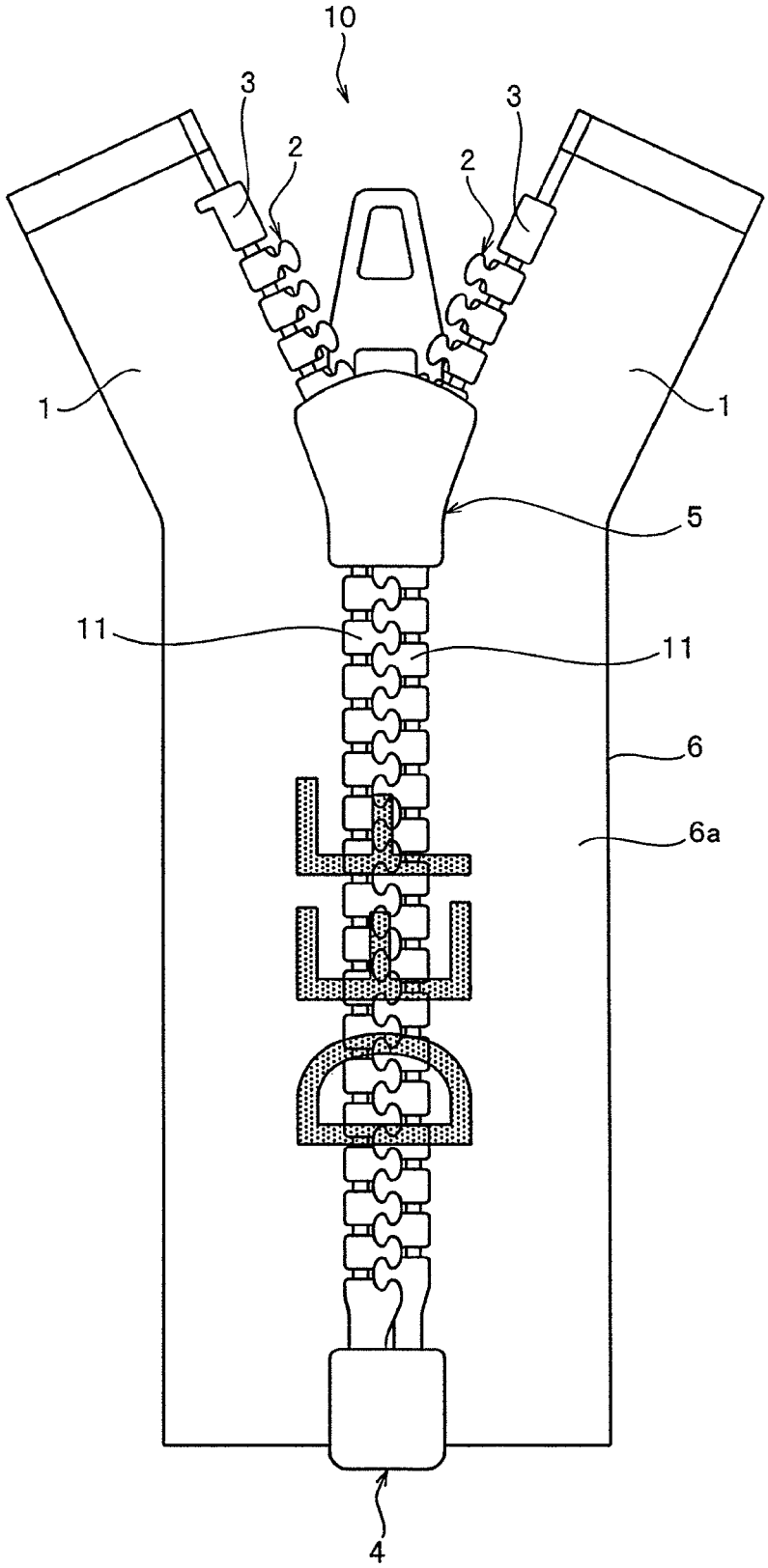
FIG. 5 is a rear view illustrating the slide fastener when a rear side of the fastener element is colored by using an inkjet method.

For example, if the semispherical recesses 13 are formed on both the first surface 12*a* and the second surface 12*b* of the fastener element 11, as illustrated in FIG. 1, the fastener tape 6 and an outer surface (first surface 12*a*) of the fastener element 11 may be colored to have desired shape and color by using an inkjet method, and as illustrated in FIG. 5, the fastener tape 6 and a rear surface (second surface 12*b*) of the fastener element 11 may be easily colored to have desired shape (for example, alphabet letter) and color.

Further, in the slide fastener 10 according to the first embodiment, although the fastener element 11 has a symmetrical shape on a surface side and a rear surface side of the fastener tape 6, the fastener element 11 may have different shapes on a surface side and a rear surface side of the fastener tape 6 in the invention.

Figure 6:
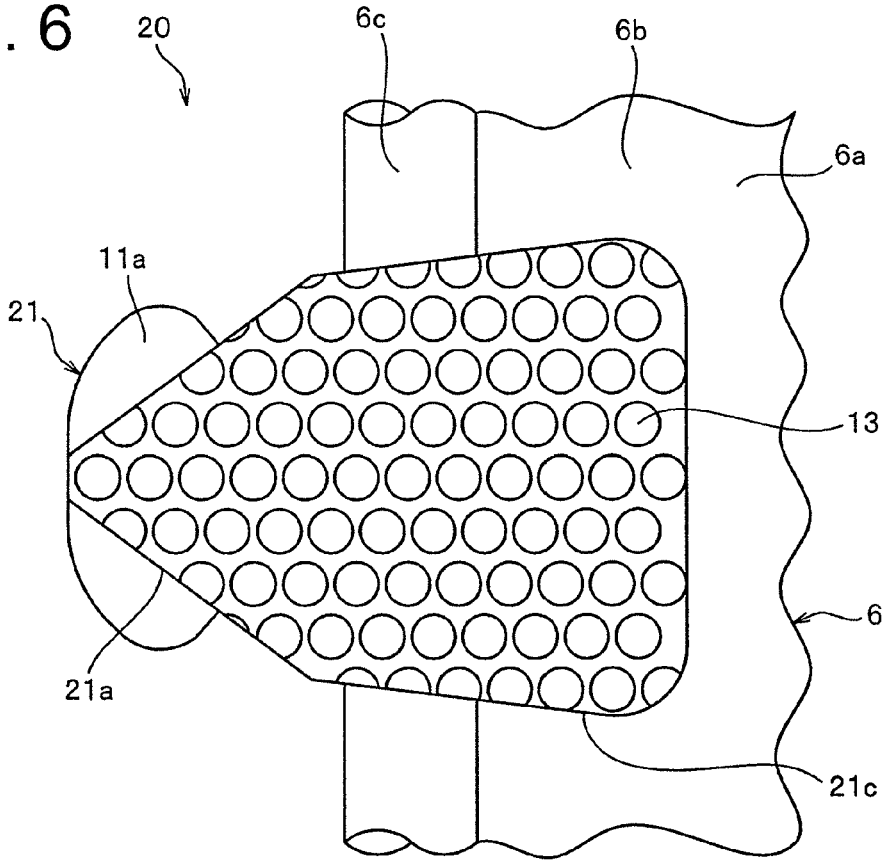
FIG. 6 is a front view of the fastener element according to a modified example of the first embodiment.
Figure 7:
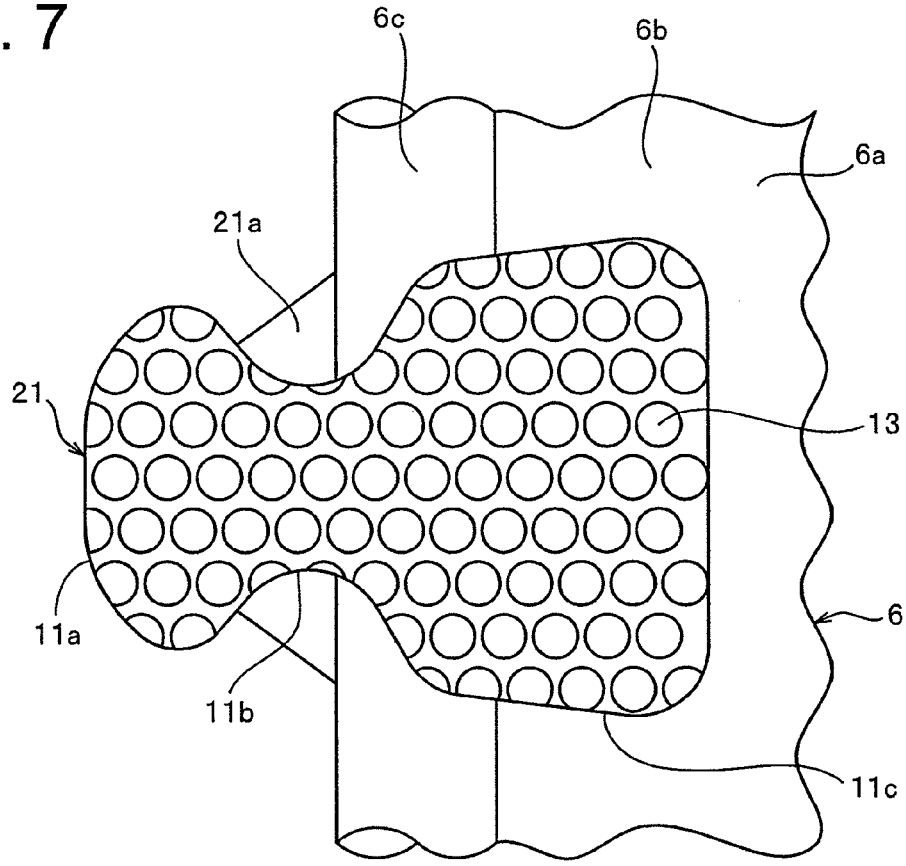
FIG. 7 is a rear view of the fastener element.

For example, as illustrated in FIGS. 6 and 7 as a modified example of the first embodiment, in a slide fastener 20 according to the modified example, a fastener element 21 has different shapes on a surface side and a rear surface side of the fastener tape 6. That is, a half portion (see FIG. 7) disposed on a tape surface side of the fastener element 21 has a body 11*c*, a neck 11*b*, and a coupling head 11*a* as in the first embodiment, but a half portion (see FIG. 6) disposed on a tape rear surface side of the fastener element 21 has a body 21*c* fixedly attached to the fastener tape 6, and a substantially triangular head 21*a* installed to extend from the body 21*c* to an outer side of the fastener tape 6. In this case, the surfaces of the body 11*c*, the neck 11*b*, and the coupling head 11*a* disposed on the tape surface side form a first surface 22*a*, and the surfaces of the body 21*c* and the head 21*a* disposed on the tape rear surface side form a second surface 22*b*.

Further, the plurality of recesses 13 is disposed in zigzag on both the first surface 22*a* and the second surface 22*b* of the fastener element 21 according to the modified example, and the recesses 13 disposed on the first and second surfaces 22*a* and 22*b* are formed to have a semispherical shape each having the same size. In this case, the recesses 13 disposed on the first and second surfaces 22*a* and 22*b* are disposed at a ratio of one to twenty five recesses 13 per area of 1 $mm^2$, and preferably at a ratio of nine to sixteen recesses 13 per area of 1 $mm^2$.

The recesses 13 (except for the recesses 13 having a flaw therein) disposed on the first and second surfaces 22*a* and 22*b* have a capacity of 0.002 $mm^3$ to 0.27 $mm^3$ and a diameter of 0.05 mm to 0.5 mm. Further, on the first and second surfaces 22*a* and 22*b*, the interval between the adjacent recesses 13 is set to 0.05 mm to 0.3 mm.

In this condition, in regard to the slide fastener 20 of the modified example having the fastener element 21 where the recesses 13 are formed on the first and second surfaces 22*a* and 22*b*, when the front and back surfaces of the fastener tape 6 and the fastener element 21 are colored through an inkjet method, the ink droplets ejected onto the first surface 22*a* of the fastener element 21 may be received by the plurality of semispherical recesses 13 disposed in zigzag and may be stably fixed to the first surface 22*a*, as in the first embodiment. Further, the ink droplets ejected to the second surface 22*b* of the fastener element 21 may also be received by the plurality of semispherical recesses 13 disposed in zigzag and stably fixed to the second surface 22*b*.

Thereafter, a desired pattern or color is continuously dyed on the front and back surfaces of the fastener tape 6 and the fastener element 21 by heat-treating the slide fastener 20 where ink droplets are attached to the front and back surface of the fastener tape 6 and the fastener element 21, and it is possible to obtain the slide fastener 20 where the contour of the pattern or color thereof is formed clearly and neatly. Further, the design of the pattern is not specifically limited, and the pattern includes a pattern having two or more colors.

Meanwhile, since the plurality of recesses 13 is formed on the entire first surface 22*a* and second surface 22*b* of each fastener element 21 when the above-described fastener chain for the slide fastener 20 according to the modified example is dyed through piece-dyeing, the dye can be smoothly and widely spread on the surface and rear surface of the fastener element 21 when the fastener chain is wound on the beam and is dyed in a dyeing pot. For this reason, the fastener chain can be uniformly and stably dyed to have a desired color without generating color stains in the fastener element 21.

In regard to the slide fastener 20 according to the modified example, when the first and second surfaces 22*a* and 22*b* of the fastener element 21 are painted and colored through ejection, surface-treated through metal plating or deposition, or surface-treated by adhering a sheet-shaped film through thermal transfer, the attaching strength or bonding strength of the paint film, the coating or the film disposed on the first and second surfaces 22*a* and 22*b* can be increased and the paint film, the coating, or the film cannot be easily peeled off from the first and second surfaces 22*a* and 22*b*.

Further, in the slide fastener 20, the half portion on the first surface 22*a* side of the fastener element 21 and the half portion of the second surface 22*b* side have different shapes, and may give different impressions to a user.

A recess 13 is formed neither on a second surface 22*b* side surface (see FIG. 6) of the coupling head 11*a* disposed on the tape surface side nor on a first surface 22*a* side surface (see FIG. 7) of the coupling head 21*a* disposed on a tape rear surface side. This is for securing strength against the front and back force by allowing the second surface 22*b* side surface of the coupling head 11*a* and the first surface 22*a* side surface of the counterpart coupling head 21*a* to contact each other on a wider surface when the left and right fastener elements 21 are coupled to each other.

Second Embodiment

Figure 8:
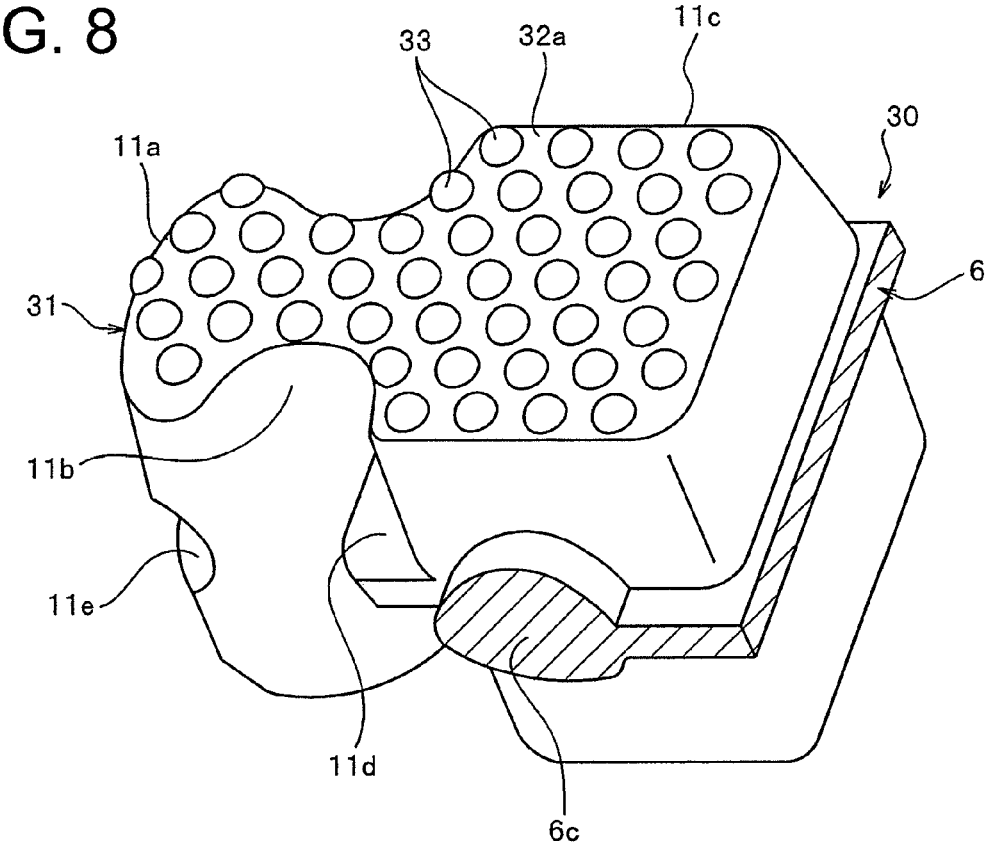
FIG. 8 is an enlarged perspective view illustrating a fastener element of a slide fastener according to a second embodiment of the invention.
Figure 9:
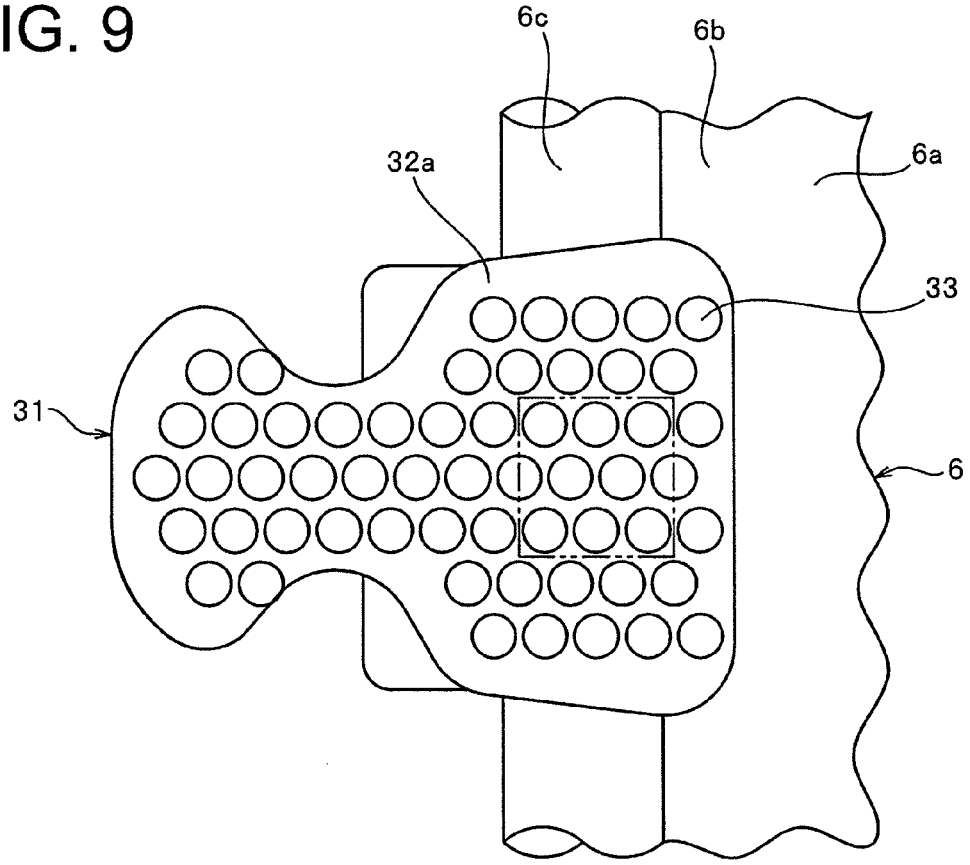
FIG. 9 is a front view of the fastener element.
Figure 10:
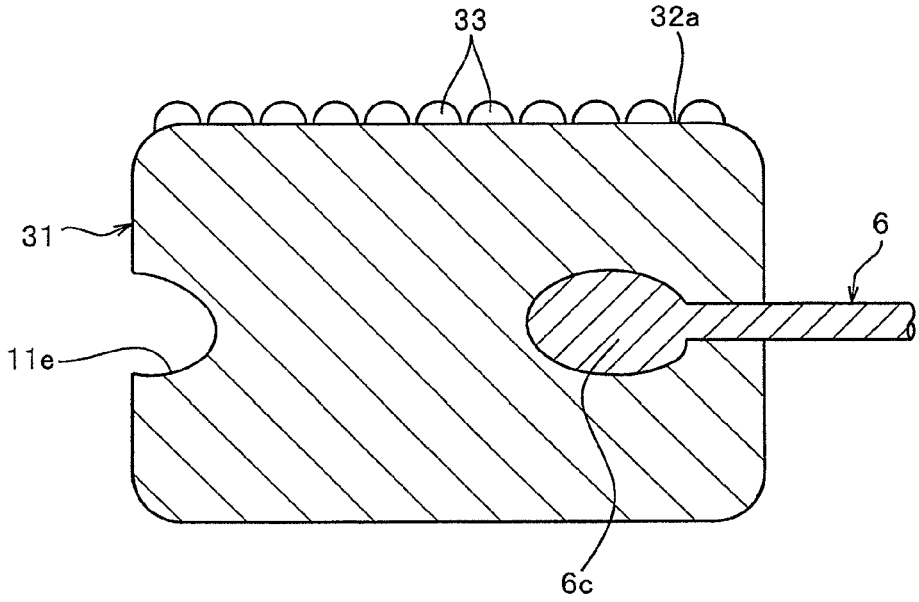
FIG. 10 is a sectional view of the fastener element.

FIG. 8 is an enlarged perspective view illustrating a fastener element of a slide fastener according to a second embodiment. FIG. 9 is a front view of the fastener element, and FIG. 10 is a sectional view of the fastener element.

In a slide fastener 30 according to the second embodiment, a plurality of semispherical bosses 33 is formed on a first surface 32*a* of each fastener element 31 instead of the plurality of semispherical recesses 13 formed in the above-described fastener element 11 of the first embodiment, and the other configurations are substantially the same as the above-described slide fastener 10 according to the first embodiment.

Thus, in the second embodiment, the configurations of the plurality of bosses 33 formed on the first surface 32*a* of each fastener element 31 will be mainly described, and the components and members having the same configurations as the above-described slide fastener 10 of the first embodiment will be provided with the same reference numerals and a description will be omitted. Further, in the third to fifth embodiments which will be described below, the components and members having the same configurations as the above-described slide fastener 10 of the first embodiment will also be provided with the same reference numerals and a description thereof will be omitted.

In each fastener element 31 of the second embodiment, a plurality of semispherical bosses 33 having the same shape and size is disposed in zigzag on the substantially entire first surface 32*a*. Further, if the bosses 33 have similar shapes, the bosses 33 may be formed to have different sizes. Further, the shape of the bosses 33 is not limited to the semispherical shape, but conic shapes or frustum shapes may be employed.

In this case, the bosses 33 formed in each fastener element 31 are disposed at a ratio of one to twenty five bosses 33 per area of 1 $mm^2$. In particular, when colored at a resolution of 180 dpi through an inkjet method, it is preferable that the bosses are disposed at a ratio of nine to sixteen.

Further, in the fastener element 31 of the second embodiment, a space is formed between a plane connecting the apexes of the bosses 33 and the first surface 32*a* of the fastener element 31 which is flat, by forming the bosses 33 on the first surface 32*a*. The space formed in the second embodiment functions as a fixing space for receiving and fixing ink droplets, for example, when the fastener element 31 is colored through the inkjet method, and functions as a fixing space for circulating a dye and widely spreading the dye on the first surface 32*a* of the fastener element 31, for example, when the fastener chain is dyed through piece-dyeing.

In this case, the capacity of the fixing space formed for one boss 33 is set to 0.002 $mm^3$ to 0.27 $mm^3$. Here, the capacity of the fixing space formed for one boss 33 is, for example, a value obtained by calculating the capacity of the fixing space in a predetermined region and dividing the calculated capacity of the fixing space by the number of bosses 33 disposed in the predetermined region.

Further, the diameter of each boss 33 disposed on the first surface 32*a* is set to 0.05 mm to 0.5 mm, and the interval between the adjacent bosses 33 is set to 0.05 mm to 0.3 mm.

In this condition, in regard to the slide fastener 30 of the second embodiment having the fastener element 31 where the bosses 33 are formed on the first surface 32*a*, when the fastener tape 6 and the fastener element 31 are colored at a resolution of 180 dpi through an inkjet method, the ink droplets ejected onto the first surface 32*a* of the fastener element 31 are received by the fixing space having a predetermined capacity formed near the bosses 33 disposed in zigzag, and the ink droplets can be stably fixed to the first surface 32*a* of the fastener element 31. For this reason, the adjacent ink droplets attached to the first surface 32*a* can be effectively prevented from being mixed with each other.

Thereafter, a desired pattern or color is continuously given to the fastener tape 6 and the fastener element 31 and the contour of the pattern or color is formed clearly and neatly, by heat-treating the slide fastener 30 where ink droplets are attached to the fastener tape 6 and the fastener element 31, making it possible to obtain the slide fastener 30 with an enhanced appearance.

Meanwhile, when the fastener chain for the slide fastener 30 according to the second embodiment is dyed through piece-dyeing, since the fixing space having a predetermined capacity is disposed near the bosses 33 on the first surface 32*a* of each fastener element 31, the dye can more smoothly and widely spread to the surface or rear surface of the fastener element 31 when the fastener chain is wound on a beam and is dyed in a dyeing pot. For this reason, the fastener chain can be uniformly and stably dyed to have a desired color without generating color stains in the fastener element 31.

Further, in regard to the slide fastener 30 according to the second embodiment, when the first surface 32*a* of the fastener element 31 is painted and colored through ejection, surface-treated through metal plating or deposition, or surface-treated by adhering a sheet-shaped film through thermal transfer, the attaching strength or bonding strength between the first surface 32*a* and the paint film, the coating, or the film formed on the first surface 32*a* can be increased and the paint film, the coating, or the film cannot be easily peeled off from the first surface 32*a* as the fixing space having a predetermined capacity is disposed near the bosses 33 on the first surface 32*a* of each fastener element 31.

Third Embodiment

Figure 11:
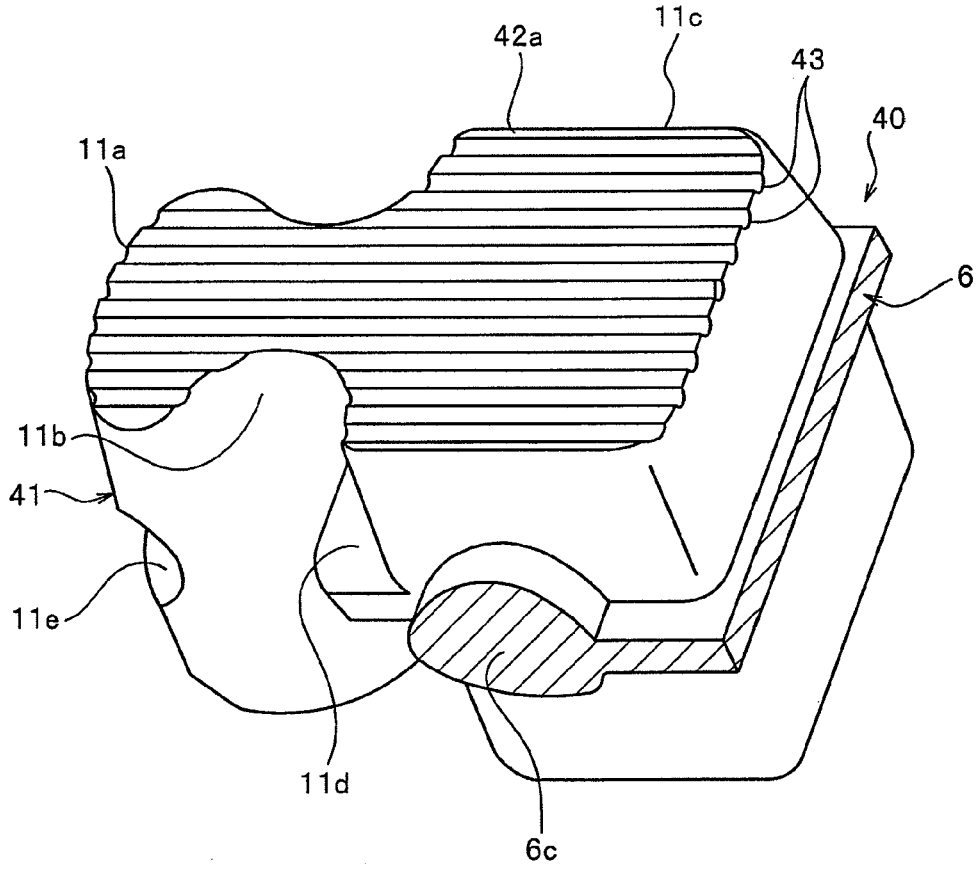
FIG. 11 is an enlarged perspective view illustrating a fastener element of a slide fastener according to a third embodiment of the invention.
Figure 12:
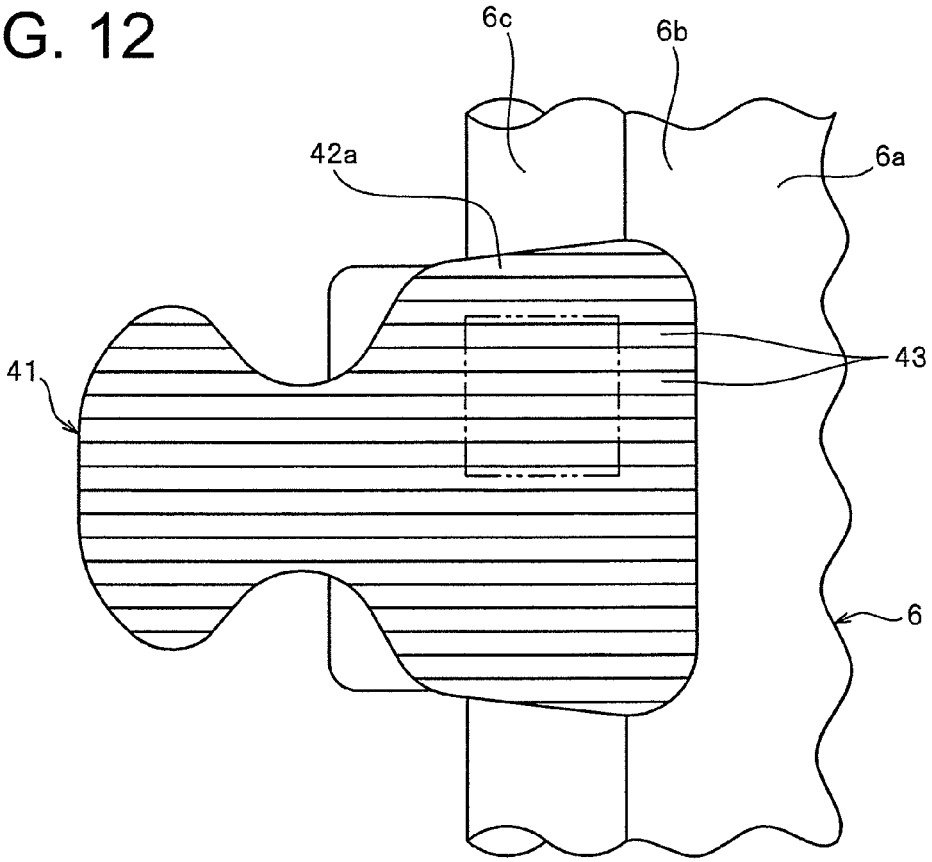
FIG. 12 is a front view of the fastener element.

FIG. 11 is an enlarged perspective view illustrating a fastener element of a slide fastener according to a third embodiment, and FIG. 12 is a front view of the fastener element.

In a slide fastener 40 according to the third embodiment, a plurality of groove-shaped recesses 43 formed in parallel to a widthwise direction of a fastener tape 6 is formed on a first surface 42*a* of each fastener element 41 instead of the plurality of semispherical recesses 13 formed in the above-described fastener element 11 of the first embodiment. The slide fastener 40 according to the third embodiment has substantially the same configuration as the above-described slide fastener 10 according to the first embodiment except that the above-described groove-shaped recesses 43 are formed on the first surface 42*a* of the fastener element 41.

In each fastener element 41 of the third embodiment, the plurality of groove-shaped recesses 43 parallel to the widthwise direction of the fastener tape 6 is disposed at a predetermined interval on substantially the entire first surface 42*a*. In this case, each groove-shaped recess 43 has a semicircular cross-section and the groove width of each recess 43 is set to the same size. In the third embodiment, spaces formed in the recesses 43 function as fixing spaces. In the third embodiment, portions between the recesses 43 may be admitted as bosses, and it may be expressed that a plurality of ridge-shaped bosses parallel to the widthwise direction of the fastener tape 6 is disposed on the first surface 42*a* of the fastener element 41.

Further, in the invention, if the groove-shaped recesses 43 have similar cross-sectional shapes, the groove-shaped recesses 43 may be formed to have different sizes. Further, the cross-sectional shape of the groove-shaped recesses 43 is not limited to a semicircular shape, but triangular shapes or rectangular shapes may also be employed.

In this case, as illustrated by an imaginary line in FIG. 12, the groove-shaped recesses 43 disposed in each fastener element 41 are disposed at a ratio of one to twenty five recesses per area of 1 $mm^2$. That is, the groove-shaped recesses 43 are disposed at a ratio of one to twenty five recesses in an interval of 1 mm in a lengthwise direction of the fastener tape 6. In particular, when a color treatment is performed at a resolution of 180 dpi through an inkjet method, it is preferable that the groove-shaped recesses 43 are disposed at a ratio of three to four recesses per an interval of 1 mm.

Further, in the fastener element 41 of the third embodiment, the size of the groove width of each groove-shaped recess 43 is set to 0.05 mm to 0.5 mm, and the interval between the groove-shaped recesses 43 is set to 0.05 mm to 0.3 mm.

In this condition, in regard to the slide fastener 40 of the third embodiment having the fastener element 41 where the plurality of groove-shaped recesses 43 is formed on the first surface 42*a*, when the fastener tape 6 and the fastener element 41 are colored at a resolution of 180 dpi through an inkjet method, the ink droplets ejected onto the first surface 42*a* of the fastener element 41 may be received by the fixing spaces of the plurality of groove-shaped recesses 43 disposed in parallel to the widthwise direction of the fastener tape 6, and the ink droplets may be stably fixed to the first surface 42*a* of the fastener element 41. For this reason, the adjacent ink droplets attached to the first surface 42*a* can be effectively prevented from being mixed with each other.

Thereafter, a desired pattern or color is continuously given to the fastener tape 6 and the fastener element 41 and the contour of the pattern or color is clearly and neatly formed by heat-treating the slide fastener 40 where ink droplets are attached to the fastener tape 6 and the fastener element 41, making it possible to obtain the slide fastener 40 whose outer appearance is enhanced.

Meanwhile, since the above-described plurality of groove-shaped recesses 43 is formed on the first surface 42*a* of each fastener element 41 when the fastener chain for the slide fastener 40 according to the third embodiment is dyed through piece-dyeing, the dye can smoothly and widely spread on the surface or rear surface of the fastener element 41 when the fastener chain is wound on the beam and is dyed in a dyeing pot. For this reason, the fastener chain can be uniformmly and stably dyed to have a desired color without generating color stains in the fastener element 41.

In regard to the slide fastener 40 according to the third embodiment, when the first surface 42*a* of the fastener element 41 is painted and colored through ejection, or the first surface 42*a* of the fastener element 41 is surface-treated through metal plating or deposition, or surface-treated by adhering a sheet-shaped film through thermal transfer, since the plurality of groove-shaped recesses 43 is formed on the first surface 42*a* of each fastener element 41, the attaching strength or bonding strength between the first surface 42*a* and the paint film, the coating, or the film formed on the first surface 42*a* can be increased and the paint film, the coating, or the film cannot be easily peeled off from the first surface 42*a*.

Fourth Embodiment

Figure 13:
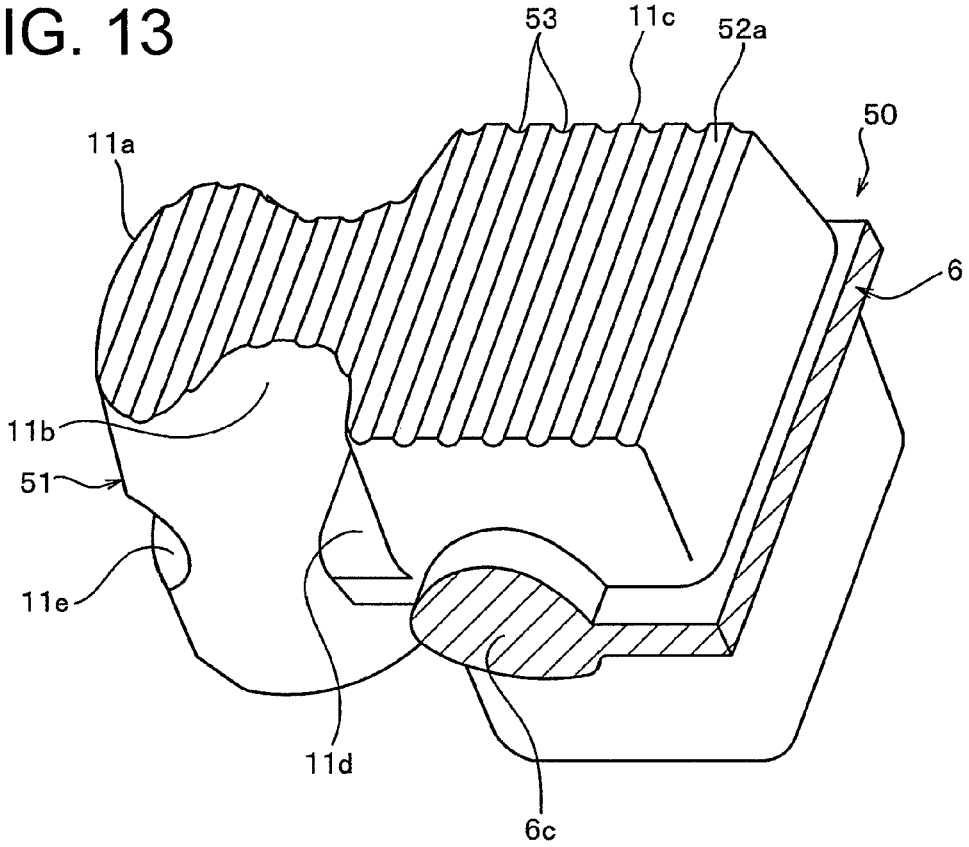
FIG. 13 is an enlarged perspective view illustrating a fastener element of a slide fastener according to a fourth embodiment of the invention.

FIG. 13 is an enlarged perspective view illustrating a fastener element of a slide fastener according to a fourth embodiment of the invention.

In a slide fastener 50 according to the fourth embodiment, a plurality of groove-shaped recesses 53 parallel to a lengthwise direction of the fastener tape 6 is formed on a first surface 52*a* of each fastener element 51 instead of the plurality of groove-shaped recesses 43 parallel to the widthwise direction of the fastener tape 6 in above-described the fastener element 41 of the third embodiment. Further, the slide fastener 50 according to the fourth embodiment has substantially the same configuration as the slide fastener 40 according to the above-described third embodiment except that the groove-shaped recesses 53 are formed in the lengthwise direction of the fastener tape 6.

That is, in each fastener element 51 according to the fourth embodiment, the plurality of groove-shaped recesses 53 parallel to the lengthwise direction of the fastener tape 6 is disposed at a predetermined interval on substantially the entire first surface 52*a*. In this case, the groove-shaped recesses 53 have a semicircular cross-section, and the grooves width of the recesses 53 are set to the same size. In the fourth embodiment, the spaces formed in the recesses 53 function as fixing spaces.

In this case, the groove-shaped recesses 53 disposed in each fastener element 51 are disposed at a ratio of one to twenty five recesses per area of 1 $mm^2$ (that is, at a ratio of one to twenty five recesses in an interval of 1 mm in the widthwise direction of the tape). In particular, when a color treatment is performed at a resolution of 180 dpi through an inkjet method, it is preferable that the recesses 53 are disposed at a ratio of three to four recesses.

Further, in the fastener element 51 of the fourth embodiment, the size of the groove width of each groove-shaped recess 53 is set to 0.05 mm to 0.5 mm, and the interval between the groove-shaped recesses 53 is set to 0.05 mm to 0.3 mm.

In this condition, in regard to the slide fastener 50 of the fourth embodiment having the fastener element 51 where the plurality of groove-shaped recesses 53 is formed on the first surface 52*a*, when the fastener tape 6 and the fastener element 51 are colored at a resolution of 180 dpi through an inkjet method, the ink droplets ejected onto the first surface 52*a* of the fastener element 51 may be received by the plurality of groove-shaped recesses 53 disposed parallel to the lengthwise direction of the fastener tape 6, and the ink droplets may be stably fixed to the first surface 52*a* of the fastener element 51. For this reason, the adjacent ink droplets attached to the first surface 52*a* can be effectively prevented from being mixed with each other.

Further, when the fastener chain for the slide fastener 50 according to the fourth embodiment is dyed through piece-dyeing, and in regard to the slide fastener 50 when the first surface 52*a* of the fastener element 51 is painted and colored through ejection, or when the first surface 52*a* of the fastener element 51 is surface-treated through metal plating or deposition or surface-treated by adhering a sheet-shaped film through thermal transfer, the same effect as in the above-described third embodiment can be obtained. In addition, the directions where the above-described groove-shaped recesses 43 and 53 are formed are not limited to the directions parallel to the widthwise direction or the lengthwise direction of the fastener tape 6, but the recesses 43 and 53 may also be formed, for example, in a direction inclined at a predetermined angle with respect to the widthwise direction of the fastener tape 6.

Fifth Embodiment

Figure 14:
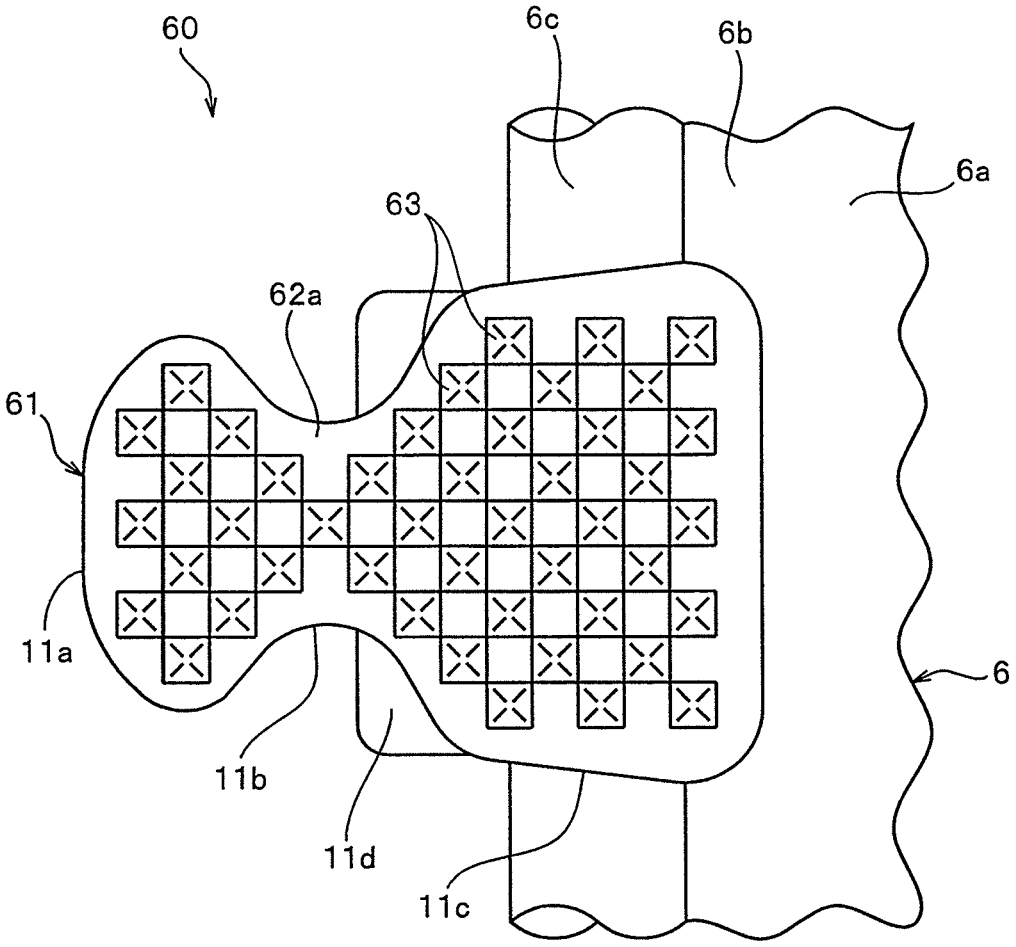
FIG. 14 is an enlarged front view illustrating a fastener element of a slide fastener according to a fifth embodiment of the invention.

FIG. 14 is an enlarged front view illustrating a fastener element of a slide fastener according to a fifth embodiment of the invention.

In a slide fastener 60 according to the fifth embodiment, a plurality of square pyramidal recesses 63 is formed on a first surface 62*a* of each fastener element 61 instead of the plurality of semispherical recesses 13 formed in the above-described fastener element 11 of the first embodiment.

That is, in each fastener element 61 according to the fifth embodiment, the plurality of recesses 63 having a square pyramidal shape of the same size is disposed in zigzag on the first surface 62*a*. In the fifth embodiment, the spaces formed in the recesses 63 function as fixing spaces.

In this case, all the recesses 63 formed on the first surface 62*a* have the same shape and size, and are disposed at a ratio of one to twenty five recesses and preferably at a ratio of nine to sixteen recesses per area of 1 $mm^2$. Further, the recesses 63 disposed on the first surface 62*a* have a capacity of 0.002 $mm^3$ to 0.27 $mm^3$, and the length of one side of the recess 63 on the first surface 62*a* is set to 0.05 mm to 0.5 mm.

In this condition, in regard to the slide fastener 60 of the fifth embodiment having the fastener element 61 where the plurality of square pyramidal recesses 63 is formed on the first surface 62*a*, when the fastener tape 6 and the fastener element 61 are colored at a resolution of 180 dpi through an inkjet method, the ink droplets ejected onto the first surface 62*a* of the fastener element 61 are received by the plurality of square pyramidal recesses 63, and the ink droplets can be stably fixed to the first surface 62*a* of the fastener element 61. For this reason, the adjacent ink droplets attached to the surface of the element can be effectively prevented from being mixed with each other.

Meanwhile, when the fastener chain for the slide fastener 60 according to the fifth embodiment is dyed through piece-dyeing, the plurality of square pyramidal recesses 63 is formed on the first surface 62*a* of each fastener element 61, and when portions of the first surface 62*a* where the recesses 63 are not disposed are observed in an order of micrometer through a microscope and the like, the plane has slight height differences.

Accordingly, even if the fastener chain is wound on the beam to overlap in several layers, a small gap is formed between a surface of a fastener element 61 wound on a layer and a rear surface of a fastener element 61 wound on the next layer. For this reason, when the fastener chain is dyed in the dyeing pot, a dye can be smoothly and widely spread on a surface and a rear surface of the fastener element 61. For this reason, the fastener chain can be uniformly and stably dyed to have a desired color without generating color stains in the fastener element 61.

Further, in regard to the slide fastener 60 according to the fifth embodiment, when the first surface 62*a* of the fastener element 61 is painted and colored through ejection, or when the first surface 62*a* of the fastener element 61 is surface-treated through metal plating or deposition, or surface-treated by adhering a sheet-shaped film through thermal transfer, the attaching strength or bonding strength of the paint film, the coating, or the film can be increased and the paint film, the coating, or the film cannot be easily peeled off from the first surface 62*a* as in the above-described first embodiment.

Further, it has been described in the above-described first to fifth embodiments that in regard to the slide fasteners 10 to 60, the fastener tape 6 and the fastener elements 11 to 61 are colored through an inkjet method. However, in the slide fasteners 10 to 60 according to the invention, recesses or bosses having the same shapes (or similar shapes) as the recesses or bosses formed in the fastener elements 11 to 61 may be formed in the same conditions as in the fastener elements 11 to 61, for example, even in the upper stopper 3 or the first surface and/or the second surface of the separable bottom end stop 4.

Figure 15:
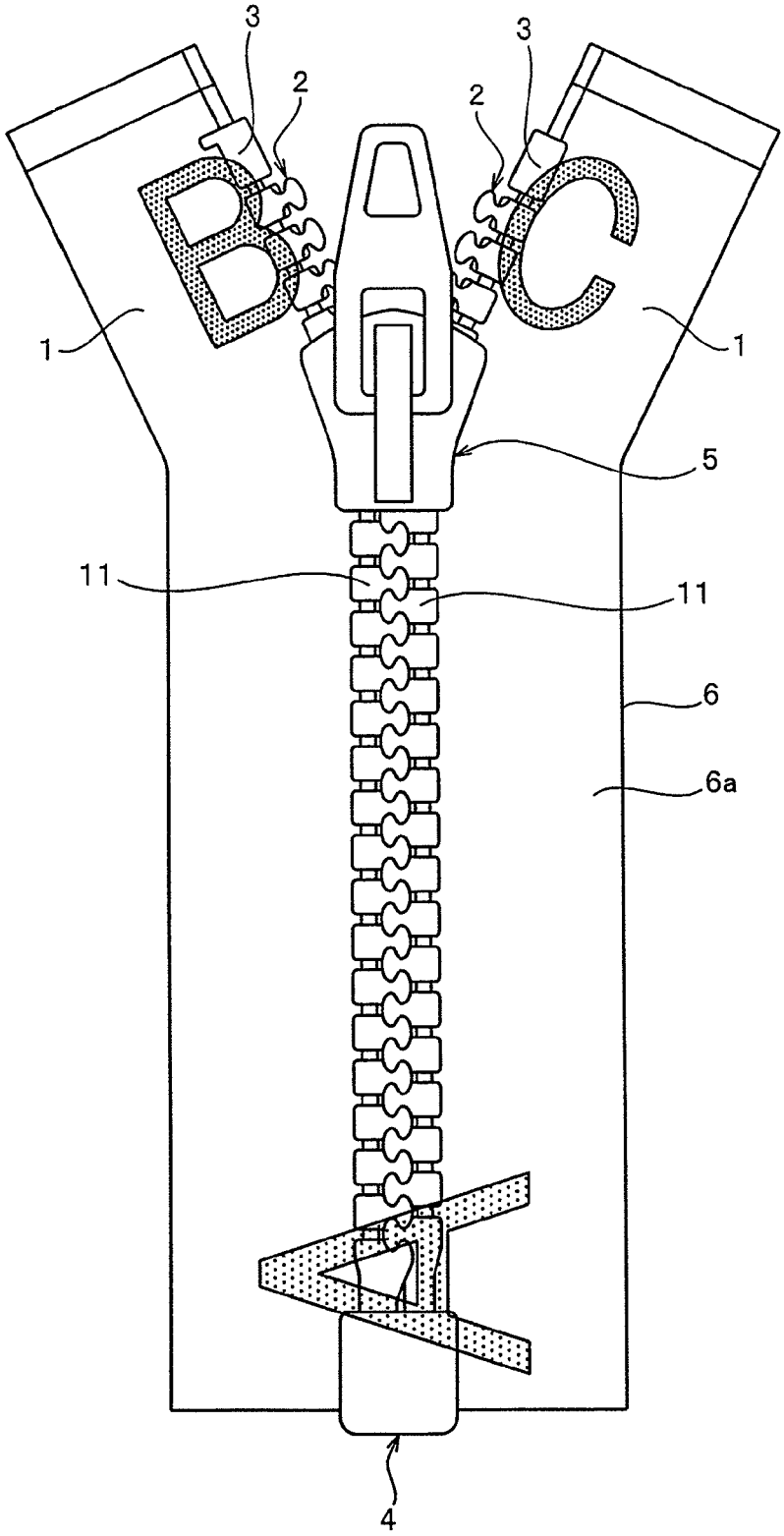
FIG. 15 is a front view of a slide fastener where an upper stopper and a separable bottom end stop as well as a fastener element are colored.

Accordingly, when the fastener tape 6 and the fastener elements 11 to 61 of the slide fasteners 10 to 60 are colored through an inkjet method, the upper stopper 3 or the separable bottom end stop 4 may also be colored through an inkjet method. Moreover, in this case, a desired pattern or color are continuously given to the upper stopper 3 or the separable bottom end stop 4 from the fastener tape 6 or the fastener elements 11 to 61, and the contours of the pattern or color can be clearly and neatly formed. For this reason, for example, as illustrated in FIG. 15, a continuous pattern (for example, an alphabet letter) or color may be neatly and stably given to the fastener tape 6, the fastener element 11, the upper stopper 3, or the separable bottom end stop 4.

Further, likewise, in the slide fasteners 10 to 60 according to the invention, recesses or bosses having the same shapes (or similar shapes) as the recesses or bosses formed in the fastener elements 11 to 61 may be formed in the same conditions as in the fastener elements 11 to 61 even on the first surface and/or the second surface of the slider. In this case, as a slider, it is preferable that, for example, as illustrated in FIG. 16, a slider 8 (also called a flat slider in some cases) where a tab is rotatably attached to a side surface of the slider and an upper blade is apt to be exposed to a surface is used.

Figure 16:
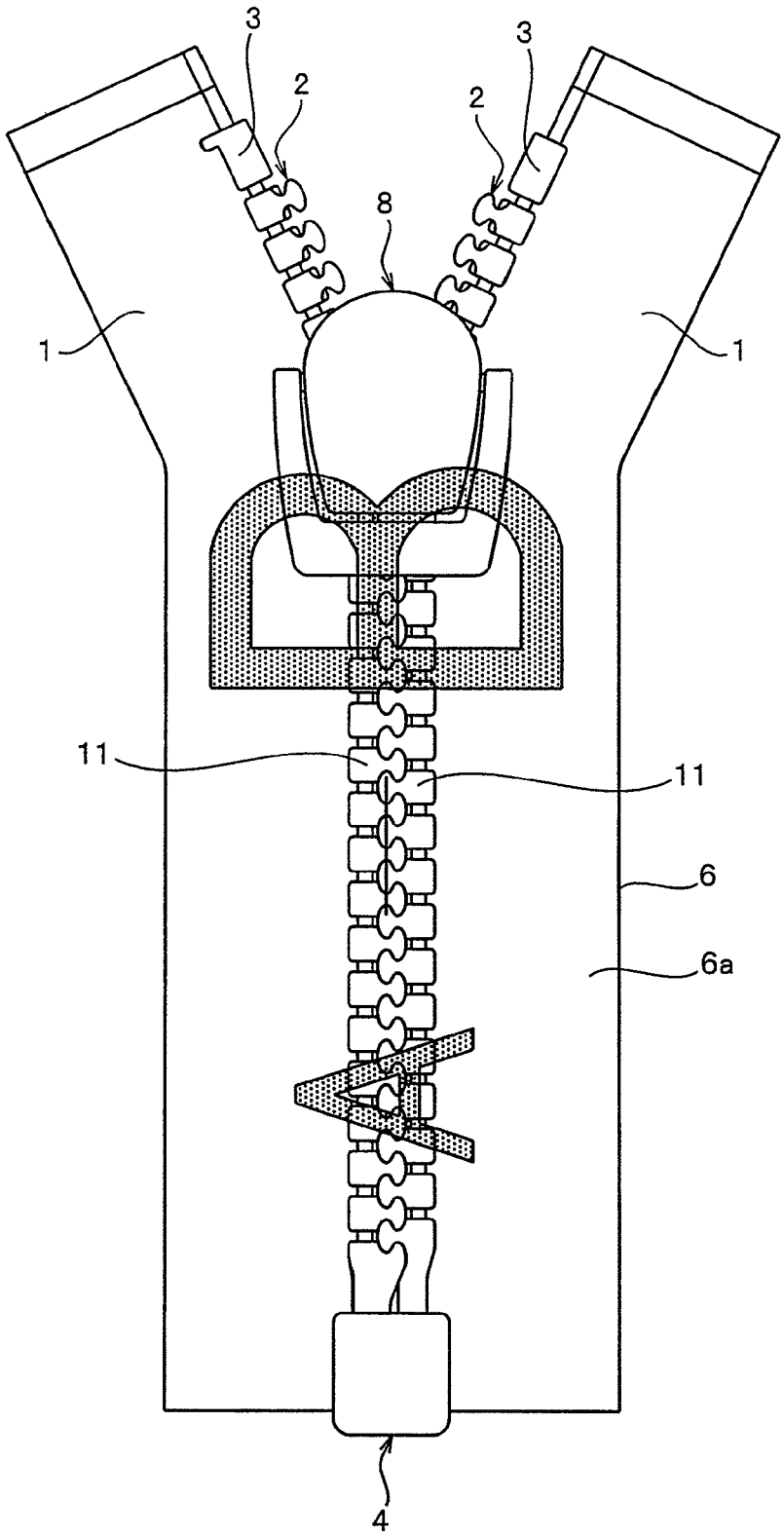
FIG. 16 is a front view of a slide fastener where a slider as well as a fastener element is colored.

Accordingly, also when the slider 8 is colored through an inkjet method, as illustrated in FIG. 16, a desired pattern (for example, an alphabet letter) or color is continuously given to the slider 8 from the fastener tape 6 or the fastener element 11 and the contour of the pattern or color can be clearly and neatly formed. For this reason, a continuous pattern or color may be neatly and stably given to the fastener tape 6, the fastener element 11, and the slider 8.

Further, in the above embodiments, the recesses or bosses on the surface of the fastener element are formed simultaneously when the fastener element is injection-molded or die-cast, but the invention is not limited thereto and the recesses or bosses may be post-processed, for example, after the fastener element is formed. In this case, a processing of pressing a roller having convexo-concavities on the fastener element or a processing through cutting may be used as the post-processing.

When a metallic fastener element is used, coating may be performed by applying a synthetic resin on the metallic surface of the fastener element in order to easily fix a coloring material to the fastener element. In this case, since the resin layer formed on the surface of the fastener element does not fill up the fixing spaces of the recesses or bosses on a surface of the fastener element even after coating, the coloring material can be stably fixed to the fixing spaces when the fastener element is colored (dyed) by the coloring material afterward. Further, by using a transparent resin layer as the resin layer formed on a surface of the fastener element, a metal-specific color tone can be given to the colored fastener element.

DESCRIPTION OF REFERENCE NUMERALS

1 Fastener stringer
2 Element row
3 Upper stopper
4 Separable bottom end stop
5 Slider
6 Fastener tape
6*a* Tape main body
6*b* Element mounting portion
6*c* Core thread
8 Slider
10 Slide fastener
11 Fastener element
11*a* Coupling head
11*b* Neck
11*c* Body
11*d* Shoulder
11*e* Concave recess
12*a* First surface
12*b* Second surface
13 Recess
13*a* First recess
13*b* Second recess
20 Slide fastener
21 Fastener element
21*a* Head
21*c* Body
22*a* First surface
22*b* Second surface
30 Slide fastener
31 Fastener element
32*a* First surface
33 Boss
40 Slide fastener
41 Fastener element
42*a* First surface
43 Recess
50 Slide fastener
51 Fastener element
52*a* First surface
53 Recess
60 Slide fastener
61 Fastener element
62*a* First surface
63 Recess

The invention claimed is:

1. A fastener stringer comprising:

a fastener tape;

a plurality of fastener elements attached along the fastener tape, at least one surface of at least some of the fastener elements being colored wherein each of the plurality of fastener elements comprises a body fixed to the fastener tape, a neck that extends from the body, and an engaging head portion disposed at a tip of the neck;

a plurality of recesses or a plurality of bosses disposed regularly on the at least one colored surface such that a predetermined interval is formed between adjacent recesses of the plurality of recesses or adjacent bosses of the plurality of bosses; and a plurality of fine fixing spaces configured to fix colors or pigments for the at least one colored surface, wherein, when the plurality of recesses are disposed on the at least one colored surface, each of the plurality of fine fixing spaces is a space formed in one of the plurality of recesses, and wherein, when the plurality of bosses are disposed on the at least one colored surface, each of the plurality of fine fixing spaces is a space formed between adjacent bosses of the plurality of bosses.

2. The fastener stringer according to claim 1, wherein the plurality of recesses or the plurality of bosses are disposed at a ratio of one to twenty five of the recesses or the bosses per 1 $mm^2$.

3. The fastener stringer according to claim 1, wherein the recesses or the bosses are formed to have a semispherical shape, a conic shape, or a frustum shape.

4. The fastener stringer according to claim 1, wherein a capacity of a space formed for one of the recesses or the bosses is set to 0.002 $mm^3$ to 0.27 $mm^3$.

5. The fastener stringer according to claim 1, wherein the plurality of recesses or bosses disposed on the one surface of the fastener element is formed to have the same shapes or similar shapes.

6. The fastener stringer according to claim 1, wherein the plurality of recesses or bosses disposed on the one surface of the fastener element is disposed in zigzag.

7. The fastener stringer according to claim 1, wherein the fastener element is colored through an inkjet method.

8. The fastener stringer according to claim 1, wherein the fastener element and the fastener tape are colored to have a pattern.

9. The fastener stringer according to claim 1, wherein the fastener element is colored through post dyeing.

10. A slide fastener, wherein the slide fastener has the fastener stringer claimed in claim 1.

11. The fastener stringer according to claim 1, wherein, when the plurality of bosses are disposed on the at least one colored surface, each of the plurality of bosses is convex and extends above the at least one colored surface.

* * * * *

UNITED STATES PATENT AND TRADEMARK OFFICE

CERTIFICATE OF CORRECTION

PATENT NO. : 8,938,863 B2
APPLICATION NO. : 13/639493
DATED : January 27, 2015
INVENTOR(S) : Yoshimichi Yamakita et al.

It is certified that error appears in the above-identified patent and that said Letters Patent is hereby corrected as shown below:

In the Specification

In column 10, line 25, delete “terephtalate,” and insert -- terephthalate, --, therefor.

In column 13, line 47-48, delete “terephtalate,” and insert -- terephthalate, --, therefor.

In column 18, line 13-14, delete “uniformmly” and insert -- uniformly --, therefor.

Signed and Sealed this
Nineteenth Day of May, 2015

Michelle K. Lee

Michelle K. Lee
*Director of the United States Patent and Trademark Office*